US011073780B2

(12) United States Patent
Sato

(10) Patent No.: US 11,073,780 B2
(45) Date of Patent: Jul. 27, 2021

(54) NON-TRANSITORY COMPUTER-READABLE STORAGE MEDIUM, MANAGEMENT DEVICE, AND MANAGEMENT METHOD

(71) Applicant: BROTHER KOGYO KABUSHIKI KAISHA, Nagoya (JP)

(72) Inventor: Yutaro Sato, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/021,352

(22) Filed: Sep. 15, 2020

(65) Prior Publication Data

US 2021/0080886 A1 Mar. 18, 2021

(30) Foreign Application Priority Data

Sep. 18, 2019 (JP) ..... JP2019-169436

(51) Int. Cl.
*G03G 15/00* (2006.01)
*B41J 29/38* (2006.01)

(52) U.S. Cl.
CPC ..... *G03G 15/5016* (2013.01); *B41J 29/38* (2013.01)

(58) Field of Classification Search
CPC .... G03G 15/08; G03G 15/5016; G03G 21/00; G03G 21/18; B41J 29/38
USPC ..... 399/75–81
See application file for complete search history.

(56) References Cited

U.S. PATENT DOCUMENTS

| | | | | |
|---|---|---|---|---|
| 6,330,402 | B1 | 12/2001 | Sakurai et al. | |
| 7,072,597 | B2 * | 7/2006 | Shimura | G03G 15/5041 399/49 |
| 7,283,258 | B1 | 10/2007 | Kuno et al. | |
| 10,234,807 | B2 * | 3/2019 | Hatanaka | G03G 21/0011 |
| 10,671,002 | B2 * | 6/2020 | Yabuki | G03G 15/50 |
| 2010/0074633 | A1 | 3/2010 | Kuwasaki | |
| 2015/0316884 | A1 | 11/2015 | Shinagawa | |

FOREIGN PATENT DOCUMENTS

| | | |
|---|---|---|
| JP | 2000-071568 A | 3/2000 |
| JP | 2001-083846 A | 3/2001 |
| JP | 2010-079575 A | 4/2010 |
| JP | 2018-092198 A | 6/2018 |

* cited by examiner

*Primary Examiner* — Hoan H Tran
(74) *Attorney, Agent, or Firm* — Scully, Scott, Murphy & Presser, PC

(57) ABSTRACT

A management method includes acquiring first and second information about remaining amounts of printing materials of first and second cartridges, and generating data representing a display screen including first and second objects for displaying first and second values determined using the first and second information. Values that the first value can take include a value corresponding to a first state in which the printing material remains in the first cartridge and the printing material remains in a tank and a value corresponding to a second state in which the printing material does not remain in the first cartridge and the printing material remains in the tank. A shape of the first object indicating the value corresponding to the second state of the values that the first value can take is different from any shape that the second object can have in accordance with the second value.

19 Claims, 9 Drawing Sheets

FIRST ACCOMMODATION STATE S1

SECOND ACCOMMODATION STATE S2

FIG. 4

MANAGEMENT DATABASE

PD

| | SERIAL NUMBER | MODEL NAME | IP ADDRESS | SUPPLY METHOD | TOTAL NUMBER TN OF PRINTABLE COPIES | NUMBER SN OF PRINTABLE COPIES OF TANK | NUMBER RN OF REMAINING PRINTABLE COPIES | CARTRIDGE REMAINING RATIO CR | INTERMEDIATE TANK REMAINING RATIO SR |
|---|---|---|---|---|---|---|---|---|---|
| EN1 | AAABBB | MDL_200 | IP_A | TWO-CHAMBER | 6000 | 400 | 3000 | 46 | 100 |
| EN2 | CCCDDD | MDL_250 | IP_B | TWO-CHAMBER | 5000 | 500 | 3000 | 56 | 100 |
| EN3 | GGGHHH | MDL_500 | IP_C | ONE CHAMBER | 4000 | -- | 3200 | 80 | -- |
| EN4 | JJJKKK | MDL_550 | IP_D | ONE CHAMBER | 3000 | -- | 300 | 10 | -- |

FIG. 6A PRINTER 100A (FIRST ACCOMMODATION STATE S1, CARTRIDGE REMAINING RATIO "LARGE")
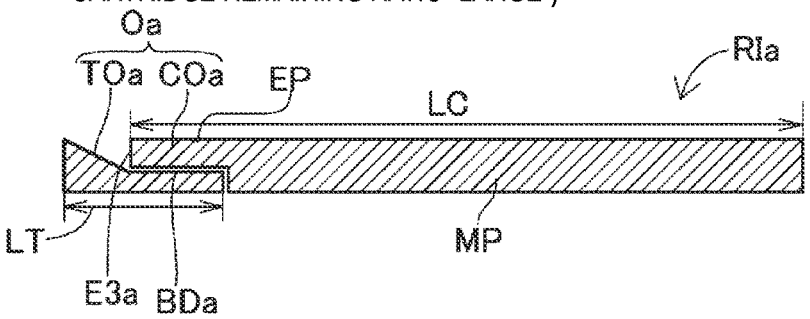
FIG. 6B PRINTER 100A (FIRST ACCOMMODATION STATE S1, CARTRIDGE REMAINING RATIO "SMALL")
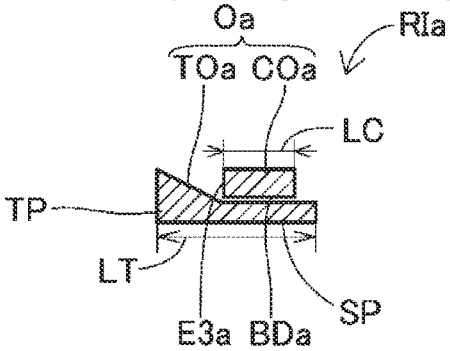
FIG. 6C PRINTER 100A (SECOND ACCOMMODATION STATE S2)
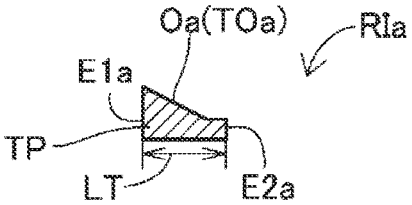
FIG. 6D PRINTER 100C (CARTRIDGE REMAINING RATIO "LARGE")
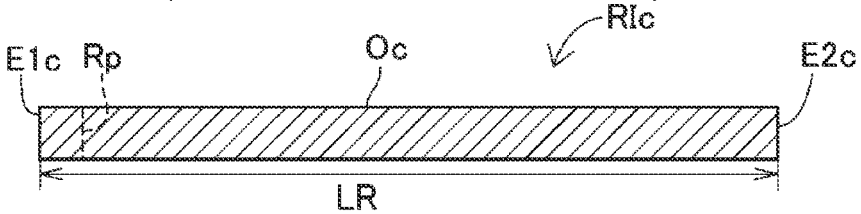
FIG. 6E PRINTER 100C (CARTRIDGE REMAINING RATIO "SMALL")
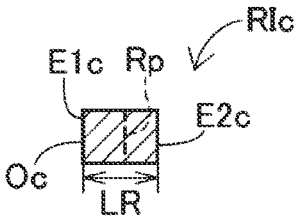

FIG. 9A SECOND EMBODIMENT
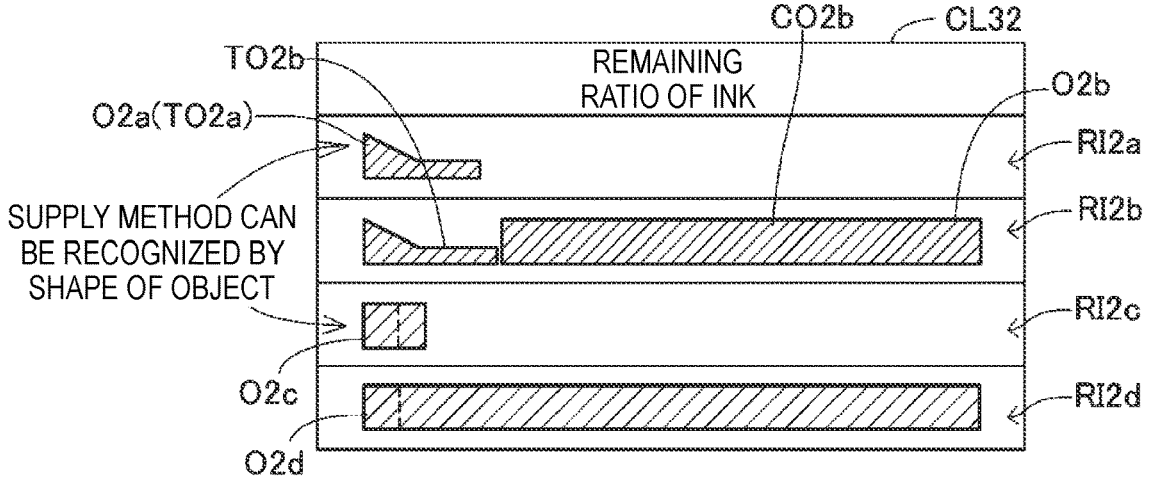
FIG. 9B THIRD EMBODIMENT
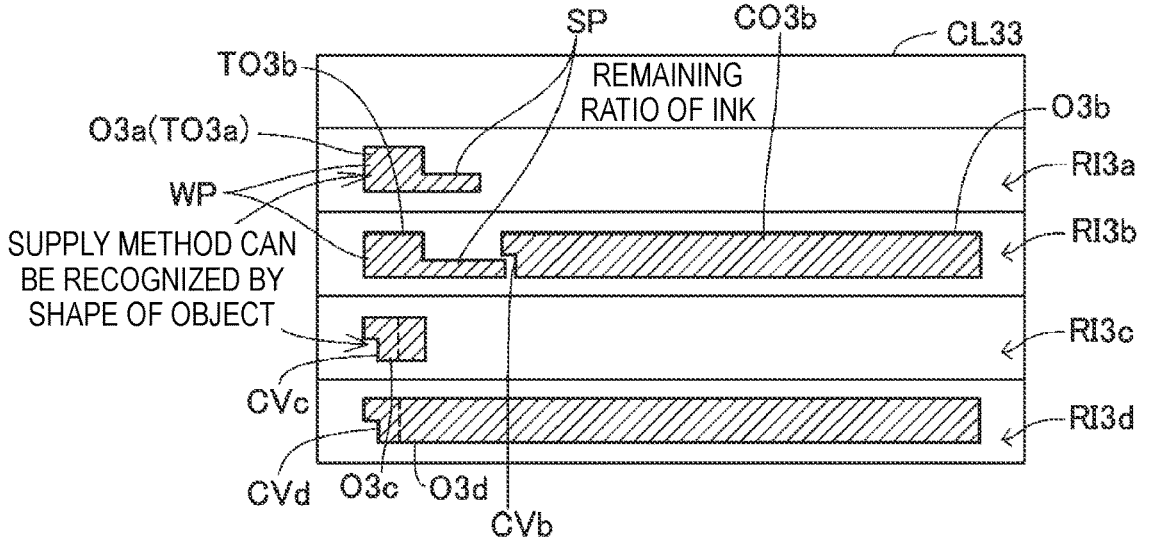
FIG. 9C FOURTH EMBODIMENT
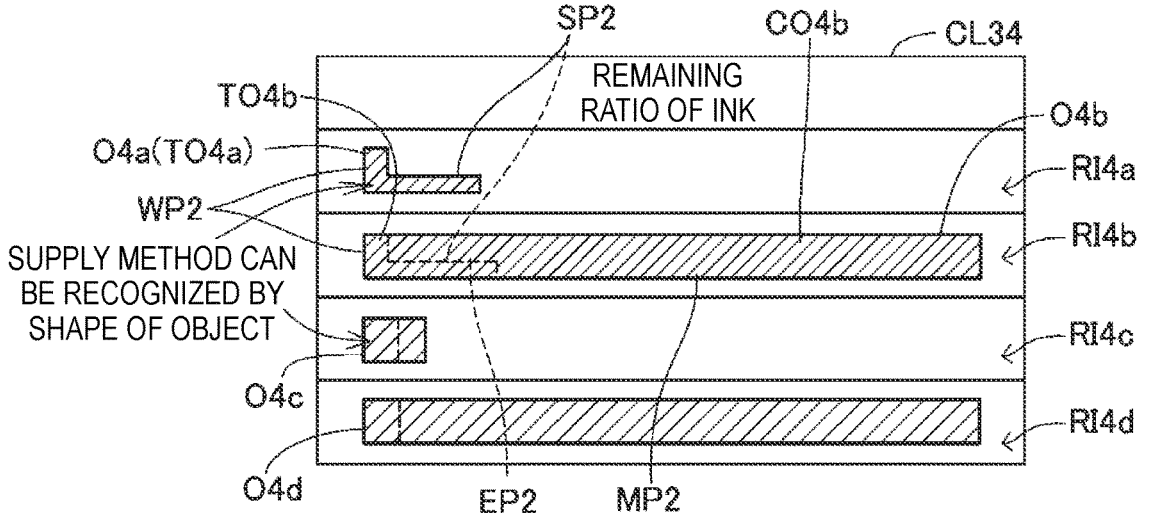

NON-TRANSITORY COMPUTER-READABLE STORAGE MEDIUM, MANAGEMENT DEVICE, AND MANAGEMENT METHOD

CROSS-REFERENCE TO RELATED APPLICATIONS

This application is based upon and claims the benefit of priority from prior Japanese patent application No. 2019-169436, filed on Sep. 18, 2019, the entire contents of which are incorporated herein by reference.

TECHNICAL FIELD

The present disclosure relates to a display screen relating to a cartridge configured to supply a printing material to a print execution unit.

BACKGROUND ART

There is known an image forming apparatus configured to display a display screen including a gauge indicating a remaining amount of toner in a small capacity cartridge and a gauge indicating a remaining amount of toner in a large capacity cartridge. In, the image forming apparatus, a position on the gauge indicating that the small capacity cartridge is empty and a position on the gauge indicating that the large capacity cartridge is empty are aligned with each other.

However, the above technology does not consider a structure where a cartridge is mounted and a printing material (for example, ink or toner) is supplied to a print execution unit. For example, when the printing material runs low, timings for ordering and replacing the cartridge may vary, depending on the structure of supplying the printing material. For this reason, when managing a plurality of print execution units including models of which the structures of supplying the printing material are different, it is difficult to perceive the timings for ordering and replacing the cartridge on a display screen, so that the convenience for a user of the display screen may be reduced.

SUMMARY

An aspect of the present disclosure provides technology of improving convenience for a user of a display screen that displays index values relating to remaining amounts of printing materials for a plurality of print execution units.

According to an aspect of the present disclosure, there is provided a non-transitory computer-readable storage medium storing a computer program readable by a computer, the computer program, when executed by the computer, causing the computer to perform: acquiring first information about a remaining amount of a first printing material of a first cartridge mounted to a first supply unit configured to supply the first printing material to a first print execution unit, the first supply unit including a tank configured to accommodate the first printing material that is supplied from the first cartridge mounted to the first supply unit, and the first supply unit being configured to supply the first printing material accommodated in the tank to the first print execution unit; acquiring second information about a remaining amount of a second printing material of a second cartridge mounted to a second supply unit configured to supply the second printing material to a second print execution unit, the second supply unit not including a tank configured to accommodate the second printing material that is supplied from the second cartridge mounted to the second supply unit; generating display screen data representing a display screen including a first display image which includes a first object for displaying a first value determined using the first information and a second display image which includes a second object for displaying a second value determined using the second information, the first value being an index value relating to the remaining amount of the first printing material and the second value being an index value relating to the remaining amount of the second printing material; and outputting the display screen data, wherein values that the first value can take include: a value corresponding to a first state in which the first printing material remains in the first cartridge and the first printing material remains in the tank; and a value corresponding to a second state in which the first printing material does not remain in the first cartridge and the first printing material remains in the tank, and wherein a shape of the first object indicating the value corresponding to the second state of the values that the first value can take is different from any shape that the second object can have in accordance with the second value.

In the meantime, the technology disclosed in the present disclosure can be implemented in a variety of forms, for example, a management device configured to manage the print execution units, a terminal device, a management method for managing the print execution units, and the like.

BRIEF DESCRIPTION OF DRAWINGS

FIG. 4 depicts an example of a management database PD of an embodiment;

FIGS. 6A to 6E depict an example of a display image;

FIG. 9A depicts an example of a display area CL32 of a management screen of a second embodiment;

FIG. 9B depicts an example of a display area CL33 of a management screen of a third embodiment; and FIG. 9C depicts an example of a display area CL34 of a management screen of a fourth embodiment.

DESCRIPTION OF EMBODIMENTS

A. Embodiment

A-1: Configuration of System 1000

Figure 1:
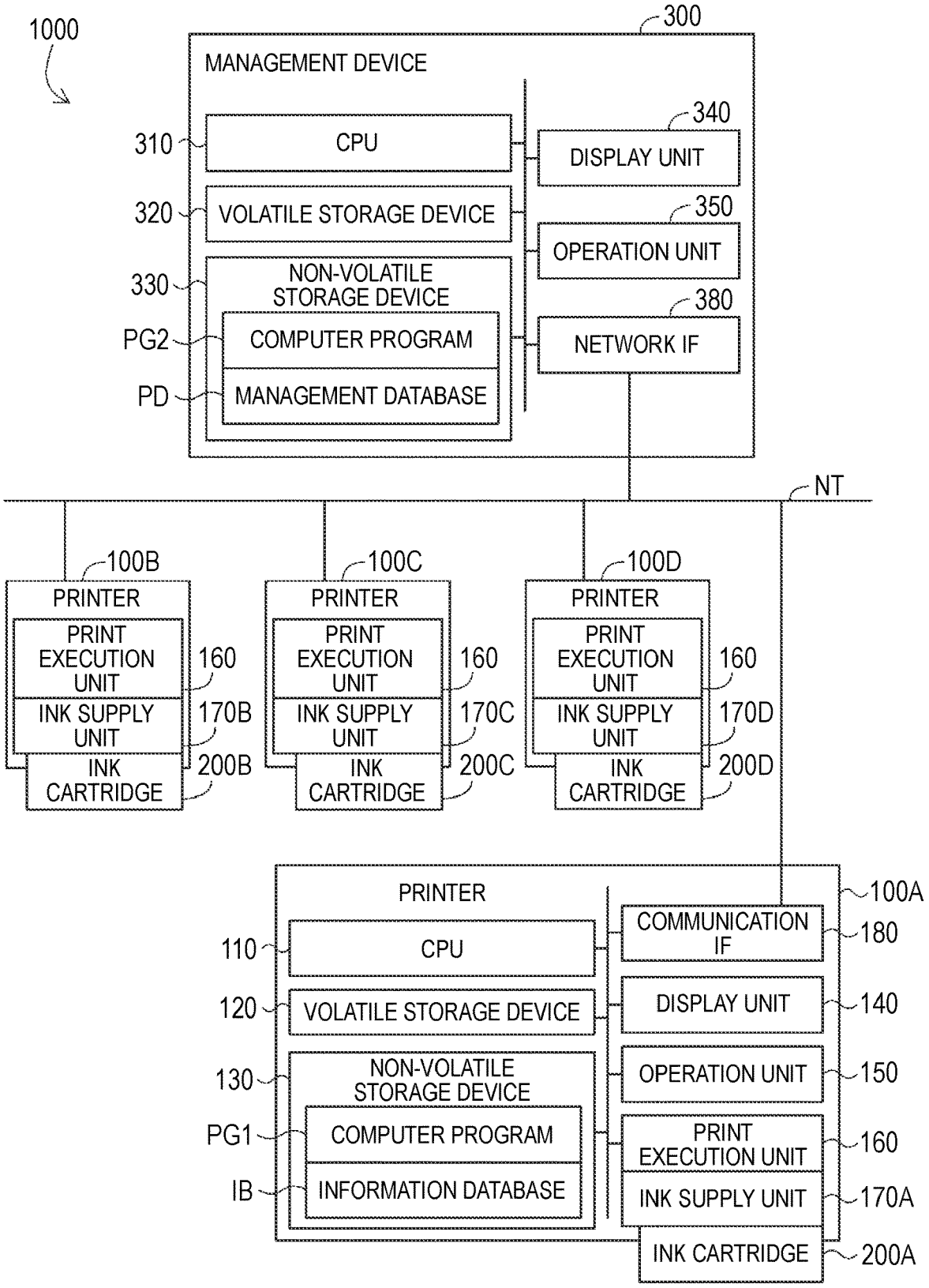
FIG. 1 is a block diagram depicting a configuration of a system 1000.

FIG. 1 is a block diagram depicting a configuration of a system 1000. The system 1000 includes printers 100A to 100D, and a management device 300 of the present embodiment. The printers 100A to 100D and the management device 300 are connected to a local area network NT, and can perform communication with each other via the local area network NT.

The printer 100A includes a CPU 110 as a controller of the printer 100A, a volatile storage device 120 such as a DRAM, a non-volatile storage device 130 such as a hard disk, a flash memory and the like, a display unit 140 configured to display an image, such as a liquid crystal monitor, an operation unit 150 configured to acquire a user operation, such as a button and a touch panel, a print execution unit 160, an ink supply unit 170A, and a communication interface (IF) 180.

The communication IF 180 is an interface for connection to the local area network NT. Specifically, the communication IF 180 is a wired interface compliant with Ethernet (registered trademark) or a wireless interface compliant with a Wi-Fi standard (IEEE (abbreviation of The Institute of Electrical and Electronics Engineers, Inc.) 802.11 standard or a standard (for example, 802.11a, 11a, 11b, 11g, 11n and the like) in accordance with the standard).

The CPU 110 is a calculation device (processor) configured to execute data processing. The volatile storage device 120 provides a buffer area in which various intermediate data that is generated when the CPU 110 executes processing is temporarily stored. In the non-volatile storage device 130, a computer program PG1 for controlling the printer, and an information database IB, which will be described later, are stored.

In the present embodiment, the computer program PG1 may be provided with being stored in advance in the non-volatile storage device 130 when manufacturing the printer. Instead, the computer program PG1 may be provided in a form of being downloaded from a server connected via the Internet IT or may be provided in a form of being recorded on a CD-ROM or the like, for example.

The CPU 110 is configured to execute the computer program PG, thereby controlling the print execution unit 160 to execute printing processing of printing an image. Also, the CPU 110 is configured to execute the computer program PG1, thereby transmitting a variety of printer information about the printer 100A stored in the information database IB to the management device 300, in response to a request from the management device 300.

Figure 2A:
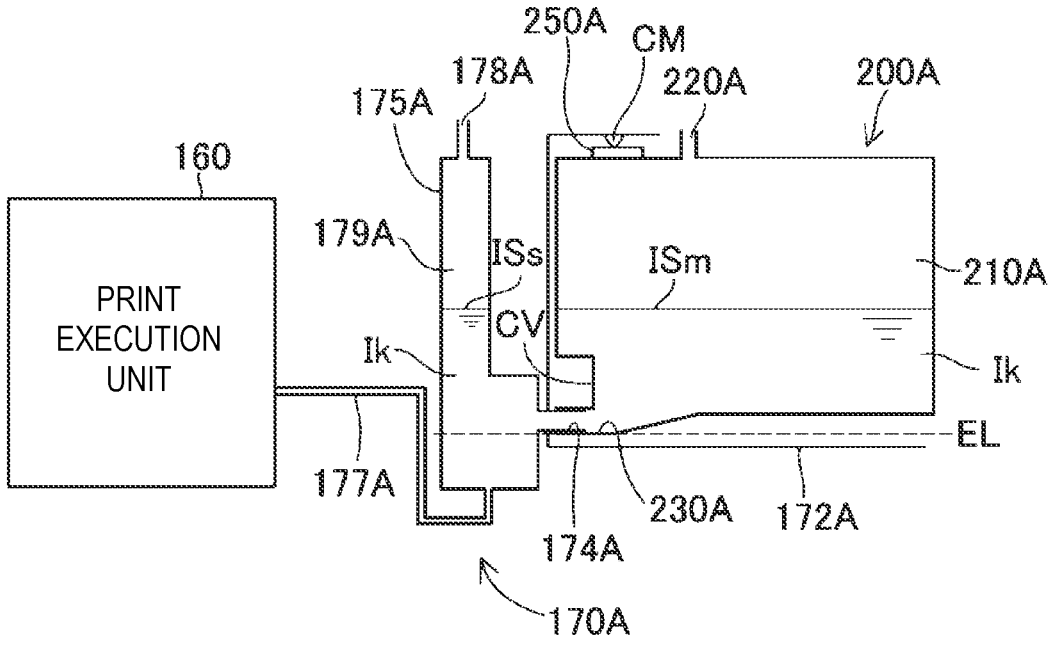
FIG. 2A is a schematic view depicting a configuration of a print execution unit 160 and an ink supply unit 170A in a first accommodation state S1.
Figure 2B:
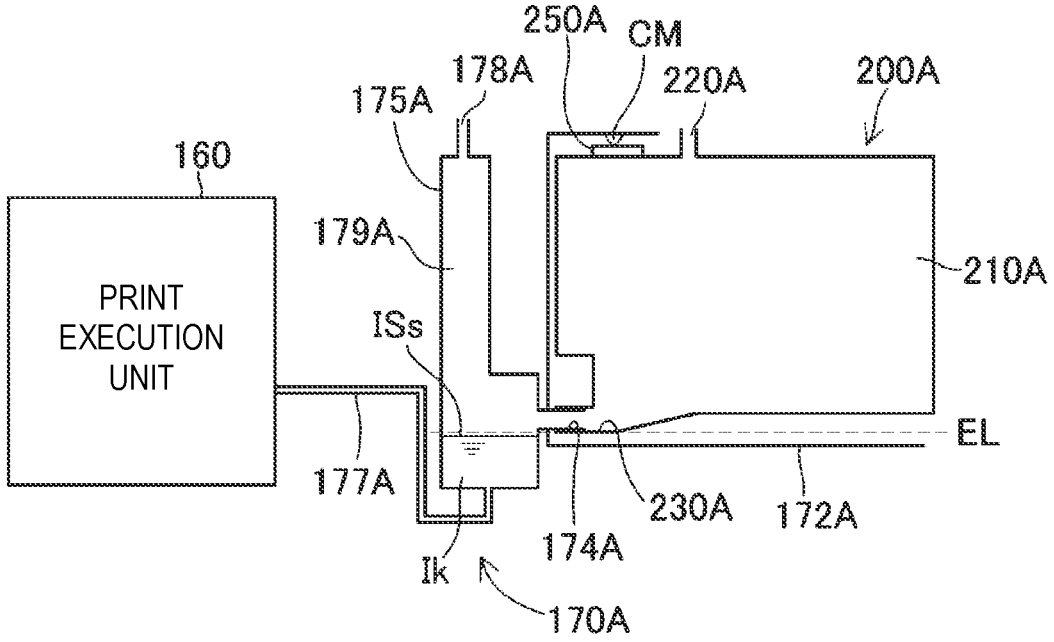
FIG. 2B is a schematic view depicting a configuration of the print execution unit 160 and the ink supply unit 170A in a second accommodation state S2.

The print execution unit 160 is configured to execute printing, under control of the CPU 110. The ink supply unit 170A is configured to supply ink Ik as a printing material to the print execution unit 160. FIGS. 2A and 2B are schematic views depicting a configuration of the print execution unit 160 and the ink supply unit 170A.

The print execution unit 160 is an inkjet-type print mechanism configured to print an image on a sheet as a printing medium by using the ink Ik supplied from an ink cartridge 200A as a printing material. Specifically, the print execution unit 160 forms an image on a sheet by discharging the ink Ik from nozzles of a print head (not shown) to form dots on the sheet. In the present embodiment, the print execution unit 160 is a monochrome print mechanism in which the ink Ik of one color (for example, black (K)) is used.

As shown in FIGS. 2A and 2B, the ink supply unit 170A includes a mounting part 172A to which the ink cartridge 200A is mounted, an ink supply path 174A, an intermediate tank 175A, and an ink flow path part 177A.

In the ink cartridge 200A, a main accommodation chamber 210A in which the ink Ik is accommodated, a communication port 220A, and an ink outlet 230A are formed. The communication port 220A is an opening for communicating the main accommodation chamber 210A and an outside air with each other. The ink outlet 230A is an opening for supplying the ink Ik in the main accommodation chamber 210A to the ink supply unit 170A. The ink outlet 230A is provided in the vicinity of a lower end of the main accommodation chamber 210A in a vertical direction so that all the ink Ik in the main accommodation chamber 210A can be supplied to the ink supply unit 170A.

An IC chip 250A is attached on an outer surface of the ink cartridge 200A. In a memory of the IC chip 250A, a variety of information about the ink cartridge 200A is stored. In the present embodiment, the information stored in the memory of the IC chip 250A includes a total number TN of printable copies, and identification information (for example, a serial number) for identifying the ink cartridge 200A. The total number TN of printable copies indicates a number of printed materials that can be printed using the ink Ik of an amount (initial amount) accommodated in the brand-new ink cartridge 200A. The total number TN of printable copies can be referred to as a value indicating the initial amount of the ink Ik of the ink cartridge 200A in a unit of a number of print copies. The total number TN of printable copies is a value obtained by dividing the initial amount of the ink Ik of the ink cartridge 200A by an ink amount that is used on average per one printed material, for example.

The mounting part 172A is a holder to which the ink cartridge 200A can be detachably mounted, for example. The ink supply path 174A is formed to communicate with the ink outlet 230A of the ink cartridge 200A mounted to the mounting part 172A. The ink Ik in the main accommodation chamber 210A is supplied to the ink supply unit 170A via the ink supply path 174A. The mounting part 172A is provided with a contact point CM that is in contact with an electrode of the IC chip 250A of the ink cartridge 200A mounted to the mounting part 172A. The printer 100A (CPU 110) can read out the information stored in the memory of the IC chip 250A and write information to the memory, via the contact point CM.

The intermediate tank 175A is formed with a sub-accommodation chamber 179A in which the ink Ik is accommodated, and a communication port 178A. The communication port 178A is an opening for communicating the sub-accommodation chamber 179A and an outside air with each other. The sub-accommodation chamber 179A is formed to communicate with the ink supply path 174A, and is configured to accommodate the ink Ik that is supplied from the ink cartridge 200A via the ink supply path 174A.

An upstream end of the ink flow path part 177A is connected to the vicinity of a bottom surface of the sub-accommodation chamber 179A of the intermediate tank 175A, and is formed to communicate with the sub-accommodation chamber 179A. A downstream end of the ink flow path part 177A is connected to the print head (not shown) of the print execution unit 160. Thereby, the ink Ik accommodated in the sub-accommodation chamber 179A is supplied to the print execution unit 160 via the ink flow path part 177A.

As can be seen from the above description, the intermediate tank 175A is arranged on a flow path of the ink k ranging from the ink cartridge 200A mounted to the mounting part 172A to the print execution unit 160.

Herein, like the ink supply unit 170A of the printer 100A, a supply method of the ink Ik in which the intermediate tank is provided on the path of the ink Ik ranging from the ink cartridge to the print mechanism is also referred to as 'two-chamber supply method'. FIG. 2A depicts the ink supply unit 170A in a first accommodation state S1 in which the ink Ik remains in the ink cartridge 200A (in the main accommodation chamber 210A) and the ink Ik also remains in the intermediate tank 175A (in the sub-accommodation chamber 179A). FIG. 2B depicts the ink supply unit 170A in a second accommodation state S2 in which no ink Ik remains in the ink cartridge 200A (in the main accommodation chamber 210A) and the ink Ik remains in the intermediate tank 175A (in the sub-accommodation chamber 179A).

The main accommodation chamber 210A of the ink cartridge 200A communicates with the outside air through the communication port 220A, and the sub-accommodation chamber 179A of the intermediate tank 175A communicates with the outside air through the communication port 178A. The sub-accommodation chamber 179A of the intermediate tank 175A includes a part that is located below (a lower side in FIGS. 2A and 2B) a vertical lower end (hereinbelow, simply referred to as 'lower end') of the main accommodation chamber 210A of the ink cartridge 200A in the vertical direction and a part that is located above the vertical lower end of the main accommodation chamber 210A in the vertical direction. For this reason, when the brand-new ink cartridge 200A is mounted, a part of the ink Ik in the ink cartridge 200A moves from the ink supply path 174A into the sub-accommodation chamber 179A. Then, a liquid surface Ism of the ink Ik in the main accommodation chamber 210A and a liquid surface ISs of the ink Ik in the sub-accommodation chamber 179A are in a state where their heights are the same (FIG. 2A).

When the ink Ik is consumed as a result of printing by the print execution unit 160, the liquid surfaces ISm and ISs become lower while maintaining the state in which the two liquid surfaces ISm and ISs have the same height. When the liquid surfaces ISm and ISs reach a position EL (also referred to as 'empty level EL') of a lower end of the main accommodation chamber 210A of the ink cartridge 200A, no ink Ik remains in the main accommodation chamber 210A of the ink cartridge 200A, and the accommodation state of the ink Ik shifts from the first accommodation state S1 (FIG. 2A) to the second accommodation state S2 (FIG. 2B). Herein, the state in which no ink Ik remains in the main accommodation chamber 210A of the ink cartridge 200A means a state in which no ink Ik moves from the main accommodation chamber 210A into the sub-accommodation chamber 179A, and includes a state in which some ink Ik is attached to an inner wall of the main accommodation chamber 210A.

Even after the shift to the second accommodation state S2, the print execution unit 160 can continue printing as long as the ink Ik remains in the sub-accommodation chamber 179A. After the shift to the second accommodation state S2, when replacing the ink cartridge 200A, the ink cartridge 200A can be replaced in a state in which the ink Ik does not remain in the ink cartridge 200A. Therefore, the ink Ik is not wasted. That is, the two-chamber supply method has an advantage that it is possible to replace the ink cartridge 200A without waste of the ink Ik, in a state in which the printing can be continued.

In the two-chamber supply method, as an example, the intermediate tank 175A is provided with a liquid surface sensor (not shown) configured to detect whether the liquid surface ISs of the ink Ik in the sub-accommodation chamber 179A has reached the empty level EL. Thereby, it is possible to detect whether the ink Ik remains in the ink cartridge 200A. As the liquid surface sensor, for example, a configuration including a float having a smaller specific gravity than the ink Ik is adopted. In this configuration, when the liquid surface ISs reaches the empty level EL, a position of the float moves vertically downward, and the movement of the float is detected, so that it is detected whether the liquid surface ISs of the ink Ik has reached the empty level EL. In other words, the liquid surface sensor is a sensor configured to detect whether the accommodation state of the ink is the first accommodation state S1 or the second accommodation state S2. As the liquid surface sensor, other well-known methods, for example, a method of measuring an electric resistance of the ink Ik may also be adopted. In the two-chamber supply method, since it is not necessary to provide the ink cartridge 200A with the liquid surface sensor, it is possible to simplify the configuration of the ink cartridge 200A.

Herein, an ink amount corresponding to a boundary between the first accommodation state S1 and the second accommodation state S2 is also referred to as a boundary ink amount. In the present embodiment, the boundary ink amount can be referred to as an ink amount in the sub-accommodation chamber 179A at the time when the liquid surface IS in the sub-accommodation chamber 179A is located at the empty level EL. Also, the boundary ink amount can be referred to as the maximum ink amount in the second accommodation state S2. Also, the boundary ink amount is the same as a capacity of the part of the sub-accommodation chamber 179A located below the vertical lower end of the main accommodation chamber 210A in the vertical direction. A number of printed materials that can be printed using the ink Ik of the boundary ink amount, i.e., a number of printed materials that can be printed using the ink Ik remaining in the intermediate tank 175A after the shift to the second accommodation state S2 is referred to as a number SN of printable copies of tank. The number SN of printable copies of tank can be referred to as a value indicating the boundary ink amount in a unit of a number of print copies. The boundary ink amount and the number SN of printable copies of tank are values that depend on a structure and a size of the intermediate tank 175A and are unique to each model of the printer.

The information database IB is a database in which printer information about the printer 100A is stored. The printer information includes information indicating a serial number and a model name, for example. The printer information includes, for example, ink information about the ink Ik, and history information about printing history. The ink information includes, for example, the total number TN of printable copies, the number SN of printable copies of tank, and a number RN of remaining printable copies. The total number TN of printable copies is acquired from the memory of the IC chip 250A of the ink cartridge 200A, for example. The number RN of remaining printable copies indicates a number of printed materials that can be printed using the ink Ik remaining in the ink cartridge 200A and the intermediate tank 175A. For example, the number RN of remaining printable copies is a number of copies obtained by subtracting a number of cumulative print copies after the ink cartridge 200A is replaced from the total number TN of printable copies (RN=TN−SN).

The printer 100A (CPU 110) is configured to maintain the printer information stored in the information database IB as the latest information by updating the history information and ink information stored in the information database IB whenever printing is performed, for example. For example, the number RN of remaining printable copies stored in the information database IB is updated by the printer 100A, for example, whenever printing is executed in the printer 100A.

The printer 100B includes an ink supply unit 170B (FIG. 1) different from the ink supply unit 170A of the printer 100A. The other configurations of the printer 100B are the same as those of the printer 100A. The ink supply unit 170B adopts a two-chamber supply method in which an intermediate tank is provided on a path of the ink Ik ranging from an ink cartridge to a print mechanism (not shown), like the ink supply unit 170A of FIGS. 2A and 2B. However, a capacity of the intermediate tank (sub-accommodation chamber) of the ink supply unit 170B is different from the capacity of the intermediate tank 175A of the ink supply unit 170A. For this reason, the number SN of printable copies of tank of the printer 100B is different from the number SN of printable copies of tank of the printer 100A.

The printer IMC includes an ink supply unit 170C different from the ink supply unit 170A of the printer 100A. The other configurations of the printer 100C are the same as those of the printer 100A. The ink supply unit 170C adopts one chamber supply method in which an intermediate tank is not provided on a path of the ink Ik ranging from an ink cartridge 200C to a print mechanism, unlike the ink supply unit 170A of FIGS. 2A and 2B.

Figure 3A:
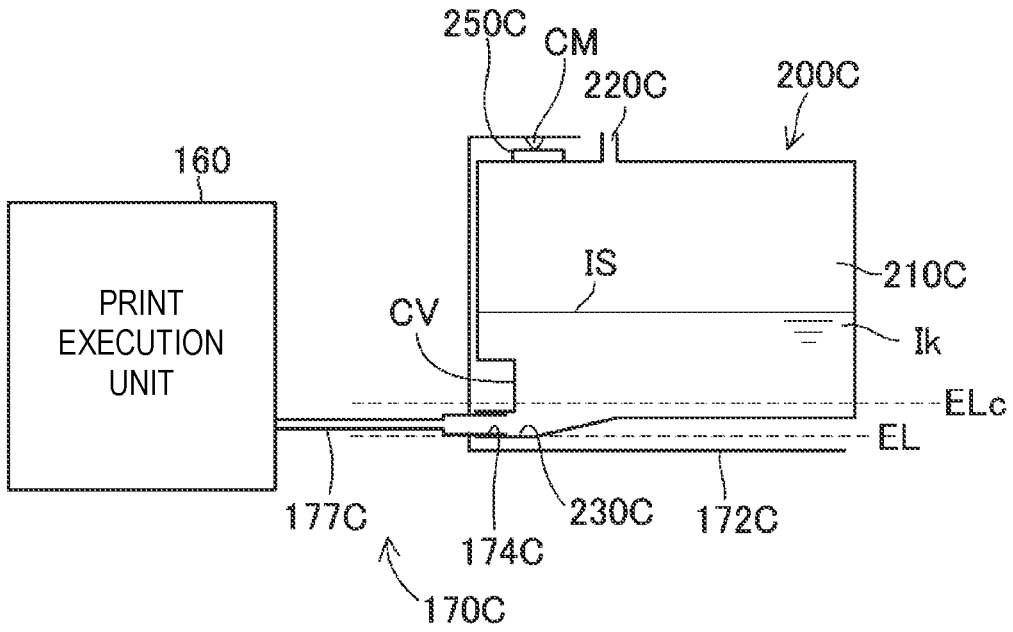
FIG. 3A is a schematic view depicting a configuration of the print execution unit 160 and an ink supply unit 170C.
Figure 3B:
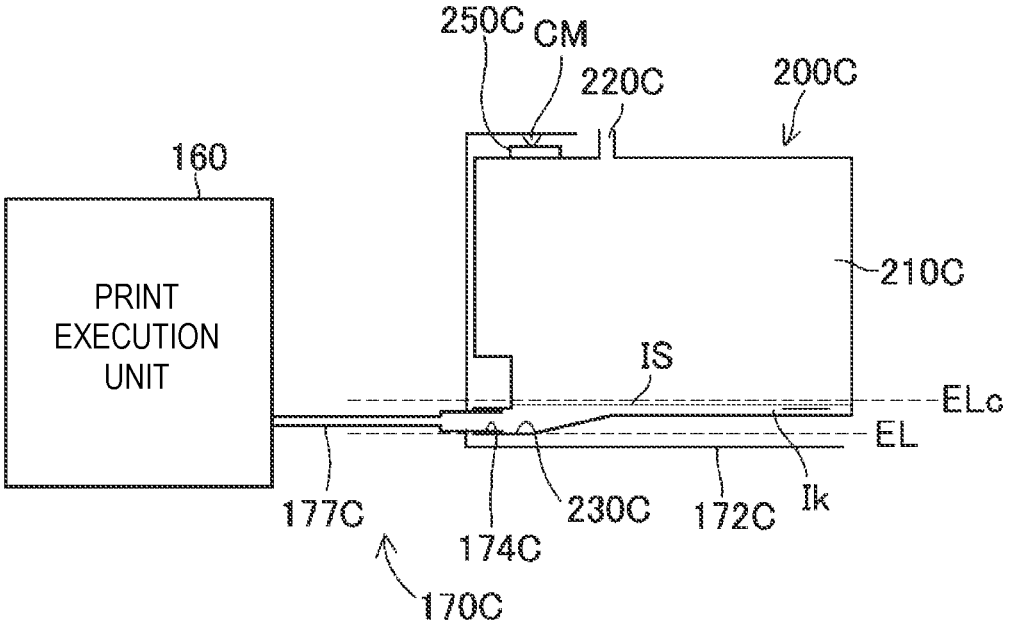
FIG. 3B is a schematic view depicting a configuration of the print execution unit 160 and the ink supply unit 170C.

FIGS. 3A and 3B are schematic views depicting a configuration of the print execution unit 160 and the ink supply unit 170C. The ink supply unit 170C includes the inkjet-type print execution unit 160, a mounting part 172C, an ink supply path 174C, and an ink flow path part 177C.

Like the ink cartridge 200A, the ink cartridge 200C is formed with an accommodation chamber 210C in which the ink Ik is accommodated, a communication port 220C for communicating the accommodation chamber 210C and an outside air with each other, and an ink outlet 230C for supplying the ink Ik to the ink supply unit 170C. Like the ink cartridge 200A, an IC chip 250C is attached on an outer surface of the ink cartridge 200C.

The mounting part 172C is a holder to which the ink cartridge 200C can be detachably mounted, for example. The ink supply path 174C is formed to communicate with the ink outlet 230C of the ink cartridge 200C mounted to the mounting part 172C. An upstream end of the ink flow path part 177C is formed to communicate with the ink supply path 174C, and a downstream end of the ink flow path part 177C is connected to a print head (not shown) of the print execution unit 160. Thereby, the ink Ik in the ink cartridge 200C (accommodation chamber 210C) is supplied to the print execution unit 160 via the ink flow path part 177C.

In the one chamber supply method, the ink cartridge 200C is provided with a liquid surface sensor (not shown) configured to detect whether the liquid surface IS of the ink Ik in the accommodation chamber 210C has reached an empty level ELc.

In the one chamber supply method, the intermediate tank provided in the two-chamber supply method is not provided. Therefore, the print execution unit 160 becomes unable to perform printing before the ink Ik does not remain in the ink cartridge 200C. For example, if a small amount of the ink Ik remains in the ink cartridge 200C, the air is mixed with the ink Ik that is supplied to the print execution unit 160. For this reason, in a state where the ink Ik of a remaining amount or more at which the air can be mixed remains in the ink cartridge 200C, the printing by the print execution unit 160 must be stopped.

For this reason, in the one chamber supply method, the empty level ELc (FIGS. 3A and 3B) is set higher than the empty level EL (FIGS. 2A, 2B, 3A and 3B) of the ink cartridge 200A in the vertical direction. FIG. 3B depicts a state in which the liquid surface IS of the ink Ik in the ink cartridge 200C has reached the empty level ELc. In this state, a small amount of the ink Ik remains in the ink cartridge 200C (accommodation chamber 210C). In the one chamber supply method, for example, the ink cartridge 200C is replaced in a state where the liquid surface IS of the ink Ik in the ink cartridge 200C has reached the empty level ELc.

A configuration of the printer 100D is the same as the printer 100C. For this reason, the printer 100D includes an ink supply unit 170D (FIG. 1) having the same structure as the ink supply unit 170C of the printer 100C. That is, the printer 100D adopts the one chamber supply method (not shown), like the printer 100C.

Herein, the initial amounts of the ink Ik in the ink cartridges 200A to 200D (FIG. 1) mounted to the ink supply units 170A to 170D are different. For this reason, the total numbers TN of printable copies of the ink cartridges 200A to 200D are different.

The management device 300 is a calculation device that is possessed by a manager of the printers 100A to 100D. The management device 300 is, for example, a personal computer, and includes a CPU 310 as a controller of the management device 300, a volatile storage device 320 such as a DRAM, a non-volatile storage device 330 such as a hard disk, a flash memory and the like, a display unit 340 configured to display an image, such as a liquid crystal monitor, an operation unit 350 such as a keyboard and a mouse, and a communication interface (IF) 380.

The communication IF 380 is connected to the local area network NT. The communication IF 380 is a wired interface compliant with Ethernet (registered trademark) or a wireless interface compliant with a Wi-Fi standard or a standard in accordance with the Wi-Fi standard, like the communication IF 180.

The CPU 310 is a calculation device (processor) configured to execute data processing. The volatile storage device 320 provides a buffer area in which various intermediate data that is generated when the CPU 310 executes processing is temporarily stored. In the non-volatile storage device 330, a computer program PG2 and a management database PD are stored.

The computer program PG2 is an application program that is provided in a form of being downloaded from a server of a business operator who manages the system 1000 or a business operator who manufactures the printers 100A to 100D. Instead, the computer program PG2 may be provided in a form of being recorded on a CD-ROM or the like or may be provided with being stored in advance in the non-volatile storage device 330 when manufacturing the management device 300.

The management device 300 (CPU 310) is configured to execute the computer program PG2, thereby executing processing of managing the printers 100A to 100D in the system 1000, screen data generation processing and management screen display processing, which will be described later, for example.

The management database PD is a database in which the printer information collected by the management device 300 is recorded. FIG. 4 depicts an example of the management database PD of the embodiment. As shown in FIG. 4, the management database PD includes entries EN1 to EN4 corresponding to the printers 100A to 100D that are management targets.

The entry EN1 corresponding to the printer 100A includes a plurality of items of the printer information of the printer 100A, for example, a serial number, a model name, an IP address, and ink-related information about the ink k. The ink-related information includes information indicating, as an example, the supply method of the ink Ik, the total number TN of printable copies, the number SN of printable copies of tank, the number RN of remaining printable copies, a cartridge remaining ratio CR, and an intermediate tank remaining ratio SR.

The serial number is identification information for identifying the printer 100A. The model name is a name indicating a model of the printer 100A. The IP address is an IP address assigned to the printer 100A.

The cartridge remaining ratio CR is a ratio (unit: %) of the ink Ik that remains in the ink cartridge 200A. Herein, in the configuration of FIG. 2A, when the ink remains in the ink cartridge 200A, the ink Ik exists even in a position higher than the empty level EL of the intermediate tank 175A. Here, this is treated as being included in the ink Ik remaining in the ink cartridge 200A. The reason is because the expression of the ink Ik existing in the intermediate tank 175A as a consumable amount after the ink Ik in the ink cartridge 200A becomes zero (in other words, after the shift from the first accommodation state S1 to the second accommodation state S2) represents a meaningful basis of replacement of the ink cartridge. Therefore, in the printer 100A adopting the two-chamber supply method, it is assumed that the cartridge remaining ratio CR is calculated using the total number TN of printable copies, the number SN of printable copies of tank (the number of printable copies after the ink Ik in the ink cartridge 200A becomes zero) and the number RN of remaining printable copies, in accordance with a following equation (1).

$$CR=100\times(RN-SN)/(TN-SN)\text{(in a case of } RN>SN)$$

$$CR=0\text{ (in a case of } RN\leq SN) \quad (1)$$

In the case of RN>SN, i.e., in the case where the number RN of remaining printable copies is larger than the number SN of printable copies of tank, it means the first accommodation state S1, and the ink Ik remains in the ink cartridge 200A. The (RN−SN) in the numerator indicates a number of print copies that can be printed using the ink Ik remaining in the ink cartridge 200A (including the ink Ik remaining in a position higher than the empty level EL of the intermediate tank 175A). The (TN−SN) in the denominator indicates a number of print copies that can be printed using the ink Ik remaining in the ink cartridge 200A (including the ink Ik remaining in a position higher than the empty level EL of the intermediate tank 175A) at a time when the brand-new ink cartridge 200A is mounted. In the case of RN≤SN, i.e., in the case where the number RN of remaining printable copies is equal to or smaller than the number SN of printable copies of tank, it means the second accommodation state S2, and no ink Ik remains in the ink cartridge 200A. For this reason, in the case of RN≤SN, the cartridge remaining ratio CR is zero (0).

In the embodiment of FIGS. 2A and 2B, the intermediate tank remaining ratio SR is a ratio (unit: %) of the ink Ik that remains in the intermediate tank 175A in a position lower than the empty level EL. The intermediate tank remaining ratio SR is calculated using the number SN of printable copies of tank and the number RN of remaining printable copies, in accordance with a following equation (2).

$$SR=100\text{ (in a case of } RN>SN)$$

$$SR=100\times RN/SN\text{ (in a case of } RN\leq SN) \quad (2)$$

In the case of RN>SN, i.e., in the case where the number RN of remaining printable copies is larger than the number SN of printable copies of tank, it means the first accommodation state S1, and the ink Ik remains in the ink cartridge 200A. For this reason, the intermediate tank remaining ratio SR is 100%. In the case of RN≤SN, i.e., in the case where the number RN of remaining printable copies is equal to or smaller than the number SN of printable copies of tank, it means the second accommodation state S2, and the ink Ik remains only in the intermediate tank 175A.

As can be seen from the above descriptions, the cartridge remaining ratio CR and the intermediate tank remaining ratio SR are two index values indicating the remaining ratio of the ink Ik that is supplied to the printer 100A having the ink cartridge 200A mounted thereto.

The entries EN2 to EN4 corresponding to the printers 100B to 100D include information indicating the same kinds of items as the entry EN1 corresponding to the printer 100A, respectively. However, since the printers 100C and 100D are printers adopting the one chamber supply method and have no intermediate tank, the entries EN3 and EN4 do not include the number SN of printable copies of tank and the intermediate tank remaining ratio SR. In the printers 100C and 100D adopting the one chamber supply method, the cartridge remaining ratio CR is calculated using the total number TN of printable copies and the number RN of remaining printable copies in accordance with a following equation (3).

$$CR=RN/TN \quad (3)$$

In the present embodiment, the serial number, the model name, and the IP address of the printer information recorded in the management database PD are acquired by the management device 300 upon start of an operation of the system 1000, for example. In the present embodiment, SNMP (Simple Network Management Protocol) is used so as to acquire the information. Specifically, the management device 300 broadcasts an SNMP request for searching for printers in the local area network NT to the local area network NT. The printers 100A to 100D send a reply including an IP address thereof, in response to the SNMP request, respectively. The management device 300 transmits, to each of the printers 100A to 100D, an SNMP request for transmission of a serial number and a model name by using the received IP addresses, and receives a serial number and a model name of each of the printers 100A to 100D, as a response to the SNMP request. The management device 300 records the serial numbers and the model names and the IP addresses to the management database PD. Thereby, the printers 100A to 100D are registered as printers of management targets.

The supply method of the ink Ik, the, the total number TN of printable copies, the number SN of printable copies of tank and the number RN of remaining printable copies of the printer information recorded in the management database PD are acquired from the printers 100A to 100D that are management targets, in screen data generation processing that will be described later. The cartridge remaining ratio CR and the intermediate tank remaining ratio SR of the printer information recorded in the management database PD are calculated by the management device 300, in the screen data generation processing.

A-2. Operations of System 1000

A-2-1. Screen Data Generation Processing

Figure 5:
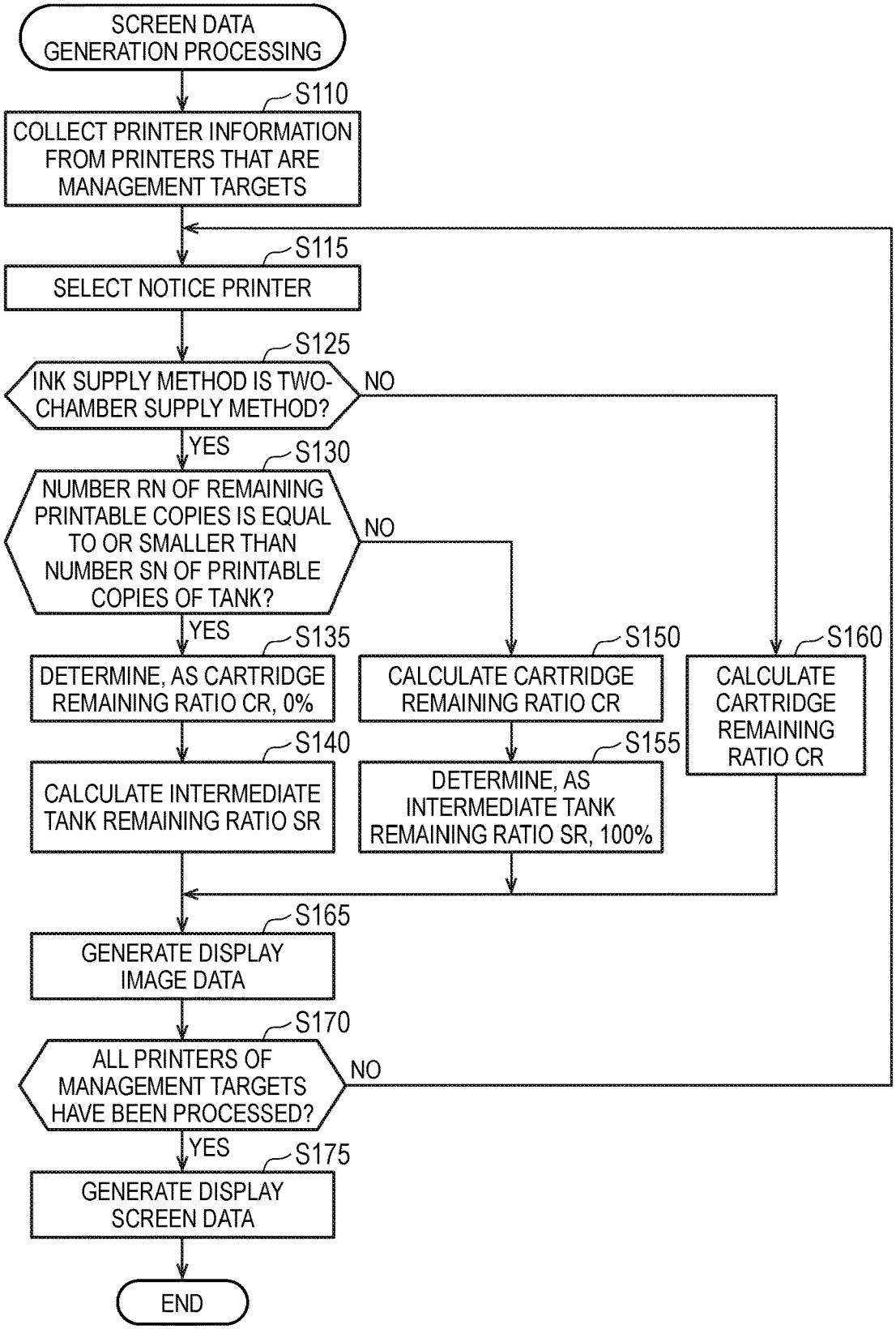
FIG. 5 is a flowchart of screen data generation processing.

The management device 300 (CPU 310) executes screen data generation processing at preset time, periodically, for example, once to several times per day, more preferably, once every 5 minutes. The screen data generation processing is processing of generating screen data for displaying a management screen DW including the printer information about the printers of management targets, in the present embodiment, the printers 100A to 100D. FIG. 5 is a flowchart of the screen data generation processing.

In S110, the management device 300 collects the printer information from each of the printers 100A to 100D that are management targets. For the collection of the printer information, SNMP is used, in the present embodiment. Specifically, the management device 300 transmits an SNMP request for items to be collected of the printer information to each of the printers 100A to 100D. The management device 300 receives the printer information from each of the printers 100A to 100D, as a response to the SNMP request. The management device 300 records the collected printer information in the management database PD. The collected printer information of each printer includes the supply method of the ink Ik, the total number TN of printable copies, the number SN of printable copies of tank, and the number RN of remaining printable copies.

In S115, the management device 30 selects one notice printer from the printers 100A to 100D that are the plurality of management targets.

In S125, the management device 300 determines whether the supply method of the ink Ik of the notice printer is the two-chamber supply method, based on the information indicating the supply method of the ink Ik, which has been acquired already as the printer information. For example, when the notice printer is the printer 100A or 100B, it is determined that the supply method is the two-chamber supply method. When the notice printer is the printer 100C or 100D, it is determined that the supply method is not the two-chamber supply method.

When it is determined that the supply method of the ink Ik is the two-chamber supply method (S125: YES), the management device 300 determines for the notice printer whether the number RN of remaining printable copies is equal to or smaller than the number SN of printable copies of tank, in S130. In other words, a case where the number RN of remaining printable copies is equal to or smaller than the number SN of printable copies of tank means that the accommodation state of the ink Ik in the notice printer adopting the two-chamber supply method is the second accommodation state S2. A case where the number RN of remaining printable copies is larger than the number SN of printable copies of tank means that the accommodation state of the ink Ik in the notice printer is the first accommodation state S1.

When it is determined that the number RN of remaining printable copies is equal to or smaller than the number SN of printable copies of tank (S130: YES), since the accommodation state of the ink Ik is the second accommodation state S2, the ink Ik does not remain in the ink cartridge 200A. In this case, therefore, the management device 300 determines, as the cartridge remaining ratio CR, 0%, in S135 (refer to the equation (1)). Then, in S140, the management device 300 calculates the intermediate tank remaining ratio SR (refer to the equation (2)).

When it is determined that the number RN of remaining printable copies is larger than the number SN of printable copies of tank (S130: NO), since the accommodation state of the ink Ik is the first accommodation state S1, the ink Ik remains in the ink cartridge 200A. In this case, therefore, the management device 300 calculates the cartridge remaining ratio CR, in S150 (refer to the equation (1)). Then, in S155, the management device 300 determines, as the intermediate tank remaining ratio SR, 100% (refer to the equation (2)).

When it is determined that the supply method of the ink Ik is not the two-chamber supply method (S125: NO), i.e., when it is determined that the supply method of the ink Ik is the one chamber supply method, in S160, the management device 300 calculates the cartridge remaining ratio CR (refer to the equation (3)). Since the printer 100C adopting the one chamber supply method has no intermediate tank, the concept of the intermediate tank remaining ratio SR does not exist in the printer 100C adopting the one chamber supply method. For this reason, in the case of one chamber supply method, the intermediate tank remaining ratio SR is not calculated.

In S165, the management device 300 generates display image data for representing a display image RI. The display image RI is an image for displaying a remaining ratio of the ink Ik (the cartridge remaining ratio CR and the intermediate tank remaining ratio SR) that is determined using the number RN of remaining printable copies and the like. Examples of a display image RIa that is represented by the display image data generated when the notice printer is the printer 100A adopting the two-chamber supply method are shown in FIGS. 6A to 6C. The display images RIa of FIGS. 6A and 6B show the remaining ratio of the ink Ik (the cartridge remaining ratio CR greater than zero (0)) corresponding to the first accommodation state S1. FIG. 6A shows a case where the cartridge remaining ratio CR is a relatively large value (100%), and FIG. 6B shows a case where the cartridge remaining ratio CR is a relatively small value (10%). The display image RIa of FIG. 6C shows the remaining ratio of the ink Ik corresponding to the second accommodation state S2. The display image RIa of FIG. 6C shows a case where the intermediate tank remaining ratio SR is 50%.

As shown in FIG. 6A, the display image RIa for the two-chamber supply method includes an object Oa. The object Oa includes two sub-objects, i.e., a cartridge object COa, and a tank object TOa.

The cartridge object COa is an object for displaying the cartridge remaining ratio CR. A length LC of the cartridge object COa in the right and left direction varies, in accordance with the cartridge remaining ratio CR. For example, the length LC of the cartridge object COa (FIG. 6A) in a case where the cartridge remaining ratio CR is 100% is ten times as large as the length LC of the cartridge object COa (FIG. 6B) in a case where the cartridge remaining ratio CR is 10%. Also, in the second accommodation state S2, since the cartridge remaining ratio CR is 0%, the length LC of the cartridge object COa is 0 (zero). Therefore, the cartridge object COa is not displayed in the display image RIa (FIG. 6C) showing the remaining ratio of the ink Ik corresponding to the second accommodation state S2.

The cartridge object COa (FIG. 6A) in the case where the cartridge remaining ratio CR is 100% has a shape having a main part MP corresponding to a range of the cartridge remaining ratio CR from about 15% to 100% and a left end portion EP corresponding to a range of the cartridge remaining ratio CR from 0% to about 15%. The main part MP is a band-shaped rectangular part extending in the right and left direction. The left end portion EP is a band-shaped rectangular portion having a vertical width, which is a half of the main part MP, and extending in the right and left direction.

The cartridge object COa (FIG. 6B) in the case where the cartridge remaining ratio CR is 10% is a 10% part on a left side of the cartridge object COa (FIG. 6A) in the case where the cartridge remaining ratio CR is 100%. Therefore, the cartridge object COa in the case where the cartridge remaining ratio CR is 10% has a shape having a part of the left end portion EP in FIG. 6A.

The tank object TOa is an object for displaying the intermediate tank remaining ratio SR. A length LT of the tank object TOa in the right and left direction varies, in accordance with the intermediate tank remaining ratio SR. For example, the length LT of the tank object TOa (FIGS. 6A and 6B) in a case where the intermediate tank remaining ratio SR is 100% is two times as large as the length LT of the tank object TOa (FIG. 6C) in a case where the intermediate tank remaining ratio SR is 50%.

The tank object TOa (FIG. 6B) in the case where the intermediate tank remaining ratio SR is 100% has a shape having a band-shaped part SP corresponding to a range of the intermediate tank remaining ratio SR from about 40% to 100% and a trapezoidal part TP corresponding to a range of the intermediate tank remaining ratio SR from 0% to about 40%. The band-shaped part SP is a band-shaped part extending in the right and left direction. The trapezoidal part TP is a trapezoidal part of which an upper side is inclined in a right and lower direction.

The tank object TOa (FIG. 6C) in the case where the intermediate tank remaining ratio SR is a 50% part on a left side of the tank object TOa (FIG. 6B) in the case where the intermediate tank remaining ratio SR is 100%. Therefore, the tank object TOa in the case where the intermediate tank remaining ratio SR is 50% has a shape having the entire trapezoidal part TP and a portion of the band-shaped part SP at the left end portion EP of FIG. 6B.

Herein, the object Oa includes a boundary portion BDa. The boundary portion BDa is a small gap between the tank object TOa and the cartridge object COa. A boundary between the tank object TOa and the cartridge object COa is explicitly represented by the boundary portion BDa.

Examples of a display image RIc that is represented by the display image data generated when the notice printer is the printer 100C adopting the one chamber supply method are shown in FIGS. 6D and 6E. The display image RIc includes an object Oc. Since the printer 100C adopting the one chamber supply method has no intermediate tank, the object Oc includes only the cartridge object for displaying the cartridge remaining ratio CR, and does not include the tank object. The display image RIc of FIG. 6D shows a case where the cartridge remaining ratio CR is 1000%. The display image RIc of FIG. 6E shows a case where the cartridge remaining ratio CR is 10%.

A length LR of the object Oc in the right and left direction varies, in accordance with the cartridge remaining ratio CR. For example, the length LR of the object Oc (FIG. 6D) in a case where the cartridge remaining ratio CR is 100% is ten times as large as the length LR of the object Oc (FIG. 6E) in a case where the cartridge remaining ratio CR is 10%.

The object Oc (FIG. 6D) in the case where the cartridge remaining ratio CR is 100% has a band-shaped rectangular shape extending in the right and left direction. The object Oc (FIG. 6E) in the case where the cartridge remaining ratio CR is 10% is a 10% part on a left side of the object Oc (FIG. 6D) in the case where the cartridge remaining ratio CR is 100%. As described above, although the length LR of the object Oc in the right and left direction varies, the object Oc has the rectangular shape all the time.

Although the detailed descriptions are omitted, a display image RIb that is represented by the display image data generated when the notice printer is the printer 100B includes an object Ob including a tank object and a cartridge object, like the display image RIa of FIGS. 6A to 6C. A display image RId that is represented by the display image data generated when the notice printer is the printer 100D includes an object Od including only a cartridge object, like the display image RIc of FIGS. 6D and 6E.

In S170 of FIG. 5, the management device 300 determines whether all the printers that are management targets have been processed as the notice printer. When it is determined that there is a printer not processed yet (S170: NO), the management device 300 returns to S115, and selects the printer not processed yet, as the notice printer. When it is determined that all the printers have been processed (S170: YES), the management device 300 proceeds to S175.

Figure 7:
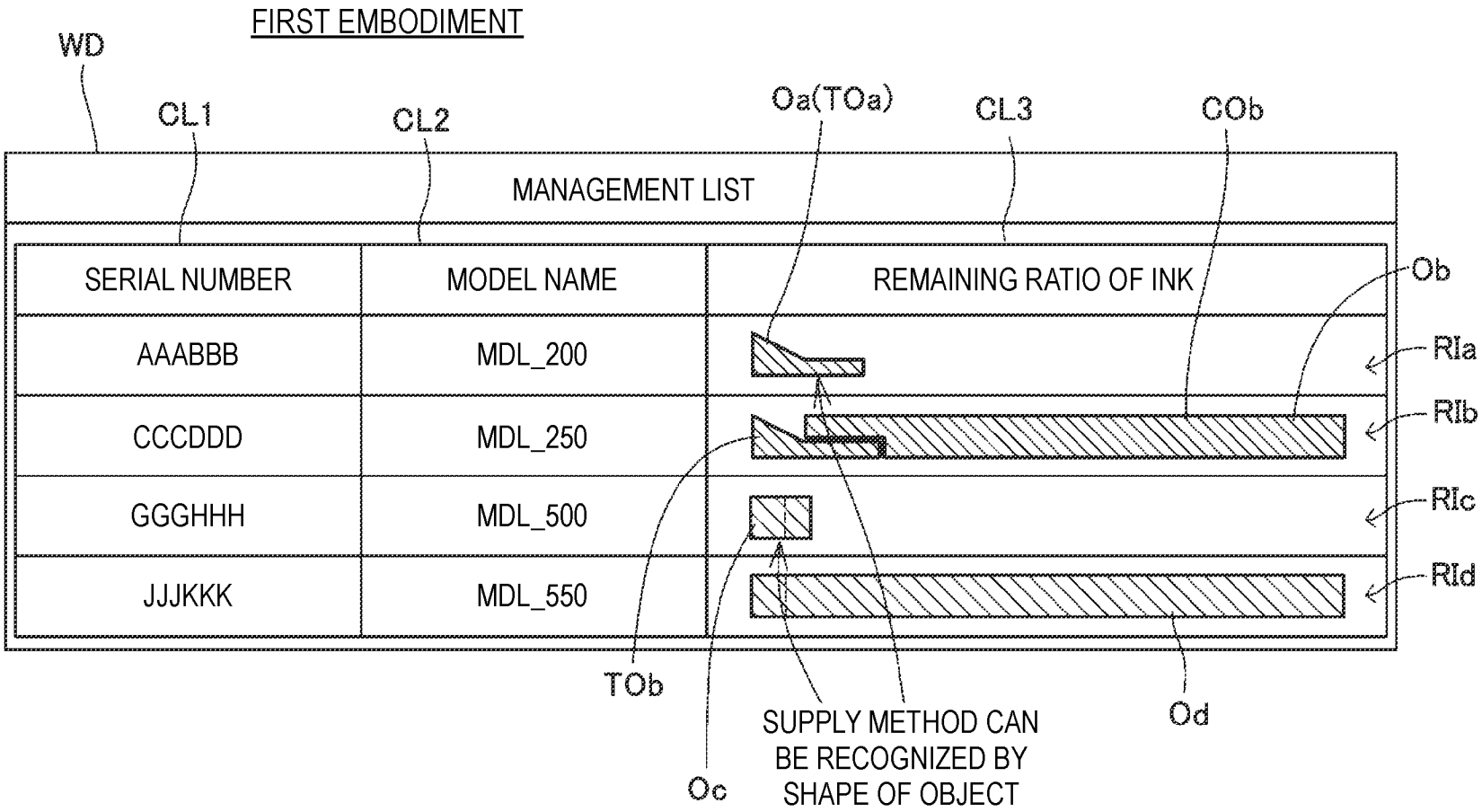
FIG. 7 depicts an example of a management screen DW.

In S175, the management device 300 generates display screen data representing a management screen DW by using the display image data generated already for each of the printers 100A to 100D. FIG. 7 depicts an example of the management screen DW. The management screen DW is a list of the printer information about the printers 100A to 100D that are management targets. The management screen DW includes a plurality of display areas for indicating a plurality of items of the printer information. FIG. 7 shows three display areas CL1 to CL3 of the display areas. For example, serial numbers of the printers 100A to 100D that are management targets are indicated in the display area CL1, and model names of the printers 100A to 100D that are management targets are indicated in the display area CL2. In the display area CL3, the display images RIa to RId are indicated as the information indicating the remaining ratios of the ink Ik of the printers 100A to 100D that are management targets.

In the example of FIG. 7, of the display images RIa and RIb corresponding to the printers 100A and 100B adopting the two-chamber supply method, the display image RIa indicates the remaining ratio of the ink Ik corresponding to the second accommodation state S2 and the display image RIb indicates the remaining ratio of the ink Ik corresponding to the first accommodation state S1. Also, of the display images RIc and RId corresponding to the printers 100C and 100D adopting the one chamber supply method, the display image RIc indicates a relatively small remaining ratio of the ink Ik and the display image RId indicates a relatively large remaining ratio of the ink Ik.

When the screen data is generated in S175, the screen data generation processing is over.

The management device 300 displays the management screen DW on the display unit 340 by using the screen data generated already in the screen data generation processing, based on a predetermined trigger. For example, the management device 300 displays the management screen DW upon start of the computer program PG2. Also, when a display request from a user is acquired via the operation unit 350, the management device 300 displays the management screen DW on the display unit 340. A user of the management device 300 is, for example, an administrator of the system 1000. The administrator of the system 1000 may be a user of the printers 100A to 100D, or a person different from the user of the printers 100A to 100D, for example, a seller of the printers 100A to 100D.

According to the present embodiment as described above, the management device 300 acquires, from each of the printers 100A to 100D, the number RN of remaining printable copies that is the information about the remaining amount of the ink Ik (S110 in FIG. 5). The management device 300 generates the display screen data representing the management screen DW including the display image RIa, which includes the object Oa for displaying the index value (for example, the remaining ratio of the ink Ik) determined using the number RN of remaining printable copies of the printer 100A, and the display image RIc for displaying the index value determined using the number RN of remaining printable copies of the printer 100C (S115 to S175 in FIG.

5). Then, the management device 300 displays the management screen DW on the display unit 340 by using the display screen data. The values that the index value (the remaining ratio of the ink Ik) about the ink Ik in the printer 100A adopting the two-chamber supply method can take include the value corresponding to the first accommodation state S1 (in the present embodiment, 0% to 100% of the cartridge remaining ratio CR) and the value corresponding to the second accommodation state S2 (in the present embodiment, 0% to 100% of the intermediate tank remaining ratio SR), as described above. The shape of the object Oa (FIGS. 6C and 7) indicating the remaining amount of the ink Ik corresponding to the second accommodation state S2 in the display image RIa corresponding to the printer 100A adopting the two-chamber supply method is different from any shape that the object Oc (FIGS. 6D, 6E and FIG. 7) can have in accordance with the remaining ratio of the ink Ik in the display image RIc corresponding to the printer 100C adopting the one chamber supply method. As a result, it is possible to improve the convenience for the user of the management screen DW that displays the index values relating to the remaining amount of the ink Ik for the plurality of printers.

For example, in the example of FIG. 7, as described above, the object Oa of the display image RIa indicates the remaining ratio of the ink Ik corresponding to the second accommodation state S2. Also in this case, the shape of the object Oa (tank object TOa) of the display image RIa has a shape including the trapezoidal part TP (FIG. 6C). In contrast, the object Oc of the display image RIc varies in terms of the length in the right and left direction in accordance with the cartridge remaining ratio CR but has the rectangular shape all the time. Due to the difference in shape, the user can recognize that the object Oa corresponds to the printer 100A adopting the two-chamber supply method. Thereby, for example, the user can easily recognize arrival of the timing for ordering the cartridge for replacement with respect to the printer 100A.

The printer 100A adopting the two-chamber supply method can continue the printing as along as the ink Ik remains in the intermediate tank 175A, even in the second accommodation state S2 where the ink Ik does not remain in the ink cartridge 200A. The printer 100C adopting the one chamber supply method cannot continue the printing in a state where the ink Ik does not remain in the ink cartridge 200C. For this reason, the preferable timing for ordering the ink cartridge 200A and the preferable timing for ordering the ink cartridge 200C are different. For example, the preferable timing for ordering the ink cartridge 200A is a timing at which the ink Ik does not remain in the ink cartridge 200A, i.e., a timing at which the cartridge object COa of the display image RIa is not displayed. The preferable timing for ordering the ink cartridge 200C is a timing at which the remaining ratio of the ink Ik reaches an ordering corresponding position RP shown with the broken line in FIGS. 6D and 6E. The ordering corresponding position RP is a position in which the remaining amount of the ink Ik in the ink cartridge 200C becomes a predetermined reference amount. For this reason, if the user cannot recognize that the object Oa corresponds to the printer 100A adopting the two-chamber supply method, the user may not know arrival of the timing for ordering the cartridge for replacement with respect to the printer 100A at the time when the user sees the object Oa.

Figure 8:
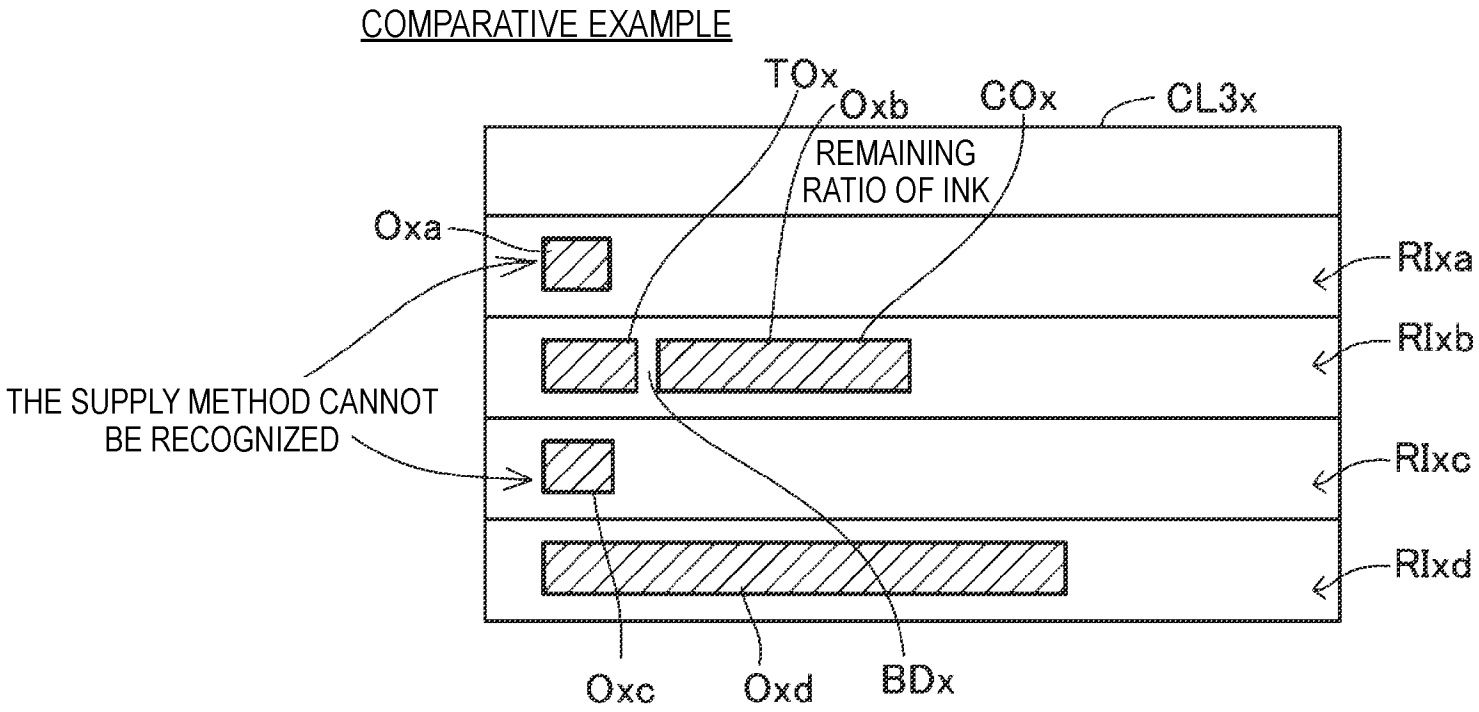
FIG. 8 depicts an example of a display area CL3*x* of a management screen of Comparative Example.

FIG. 8 depicts an example of a display area CL3*x* of a management screen in a Comparative Example. The display area CL3*x* includes display images RIxa to RIxd corresponding to the printers 100A to 100D. In the example of FIG. 8, like the example of FIG. 7, the display image RIxa indicates the remaining ratio of the ink Ik corresponding to the second accommodation state S2, and the display image RIxb indicates the remaining ratio of the ink Ik corresponding to the first accommodation state S1. Also, the display image RIxc indicates a relatively small remaining ratio of the ink Ik, and the display image RIxd indicates a relatively large remaining ratio of the ink Ik.

Objects Oxa and Oxb of the Comparative Example corresponding to the printers adopting the two-chamber supply method have shapes different from the objects Oa and Ob of the first embodiment (FIGS. 6A to 6C and FIG. 7). For example, both a tank object TOx and a cartridge object Cox of the object Oxb of the Comparative Example have rectangular shapes. Objects Oxc and Oxd of the Comparative Example corresponding to the printers adopting the one chamber supply method have the same shapes as the objects Oc and Od of the first embodiment (FIGS. 6D, 6E and 7).

When indicating the remaining ratio of the ink Ik corresponding to the first accommodation state S1, the object of the Comparative Example corresponding to the printer adopting the two-chamber supply method includes an image indicating a boundary portion BDx because it is divided into the tank object TOx and the cartridge object COx, as shown in the object Oxb of FIG. 8. However, when indicating the remaining ratio of the ink Ik corresponding to the second accommodation state S2, there is no image indicating the boundary portion because the cartridge object is not displayed and only the tank object is displayed, as shown in the object Oxa of FIG. 8. For this reason, as shown in FIG. 8, the object Oxa corresponding to the printer 100A adopting the two-chamber supply method and the object Oxc corresponding to the printer 100C adopting one chamber supply method are the same. As a result, in the Comparative Example, the user who sees the object Oxa does not know whether the object Oxa corresponds to the printer adopting the two-chamber supply method. In contrast, in the example of the first embodiment shown in FIG. 7, when indicating the remaining ratio of the ink k corresponding to the second accommodation state S2, the shape of the object Oa is different from the rectangular shapes of the objects Oc and Od. Thereby, as described above, the user who sees the object Oa can easily recognize that the object Oa corresponds to the printer adopting the two-chamber supply method.

Also, in the first embodiment, the shape of the tank object TOa shown in FIG. 6B is a combined shape of the trapezoidal part TP and the band-shaped part SP. For this reason, the shape of the tank object TOa does not become a simple rectangular shape even when the intermediate tank remaining ratio SR indicates any value between 0% and 100%. In other words, the shape of the object Oa indicating an arbitrary value between a minimum value (the intermediate tank remaining ratio SR=0%) corresponding to the second accommodation state S2 and a specific value (for example, the intermediate tank remaining ratio SR=100%) corresponding to the second accommodation state S2 of the values that the remaining ratio of the ink Ik can take is different from any shape that the object Oc can have in accordance with the cartridge remaining ratio CR. As a result, the user can recognize that the object Oa corresponds to the printer adopting the two-chamber supply method, even immediately before the intermediate tank remaining ratio SR becomes 0%.

Also, according to the first embodiment, the object Oa includes the tank object TOa and the cartridge object COa (FIG. 6A), and the shape of the tank object TOa is different from any shape that the object Oc can have in accordance with the cartridge remaining ratio CR. That is, the shape of the tank object TOa corresponding to the intermediate tank 175A, which is a configuration that is provided for the two-chamber supply method and is not provided for one chamber supply method, is different from the object Oc. As a result, when the object Oa indicates a value corresponding to the second accommodation state S2, the user can intuitively recognize that the object Oa corresponds to the printer adopting the two-chamber supply method and having the intermediate tank 175A.

Also, according to the first embodiment, the shape (FIG. 6A) of the cartridge object COa of the object Oa has the left end portion EP. Therefore, the shape of the cartridge object COa of the object Oa is different from any shape that the object Oc can have in accordance with the cartridge remaining ratio CR. As a result, when the cartridge object COa is displayed, the user can recognize that the object Oa corresponds to the printer adopting the two-chamber supply method, from the shape of the cartridge object COa.

Also, according to the first embodiment, as shown in FIGS. 6A and 6B, a shape of the end portion (the vicinity of the boundary portion BDa in FIGS. 6A and 6B) of the tank object TOa which corresponds to a boundary between the first accommodation state S1 and the second accommodation state S2 is different from shapes of end portions E1*c* and E2*c* (FIGS. 6C and 6D) of the object Oc. As a result, the user can easily recognize that the object Oa corresponds to the printer adopting the two-chamber supply method, from the shape of the end portion of the tank object TOa in the vicinity of the boundary portion BDa. Also, the shape of the end portion in the vicinity of the boundary portion BDa is different, so that the user can easily imagine that the place in which the ink Ik is stored is divided into the intermediate tank 175A and the ink cartridge 200A. Therefore, the user can intuitively recognize that the object Oa corresponds to the printer adopting the two-chamber supply method.

Also, according to the first embodiment, as described above, the shape of the object Oa in the vicinity of the boundary portion BDa and the shape of the cartridge object COa are different from the object Oc. For this reason, in the first embodiment, even when the object Oa indicates the remaining ratio of the ink Ik corresponding to the first accommodation state S, the shape of the object Oa is different from any shape that the object Oc can have in accordance with the cartridge remaining ratio CR. As a result, even when the object Oa indicates the remaining ratio of the ink Ik corresponding to the first accommodation state S1, the user can recognize that the object Oa corresponds to the printer adopting the two-chamber supply method.

As can be seen from the above descriptions, the ink cartridge 200A is an example of the first cartridge, and the ink cartridge 200C is an example of the second cartridge. The number RN of remaining printable copies acquired from the printer 100A is an example of the first information, and the number RN of remaining printable copies acquired from the printer 100C is an example of the second information. The object Oa is an example of the first object, and the object Ob is an example of the second object. The cartridge object COa is an example of the first sub-object, and the tank object TOa is an example of the second sub-object.

B. Second Embodiment

FIG. 9A depicts an example of a display area CL32 of the management screen in accordance with a second embodiment. In the second embodiment, a display area CL32 of FIG. 9A is displayed, instead of the display area CL3 (FIG. 7) of the management screen DW of the first embodiment.

The display area CL32 includes display images RI2*a* to RI2*d* corresponding to the printers 100A to 100D. In the example of FIG. 9A, like the example of FIG. 7, the display image RI2*a* indicates the remaining ratio of the ink Ik corresponding to the second accommodation state S2, and the display image RI2*b* indicates the remaining ratio of the ink Ik corresponding to the first accommodation state S1. Also, the display image RI2*c* indicates a relatively small remaining ratio of the ink k, and the display image RI2*d* indicates a relatively large remaining ratio of the ink Ik.

In the second embodiment, in the display images RI2*c* and RI2*d* corresponding to the printers 100C and 100D adopting the one chamber supply method, shapes of objects O2*c* and O2*d* are the same as those of the objects Oc and Od of the first embodiment. Also, in the second embodiment, in the display images RI2*a* and RI2*b* corresponding to the printers 100A and 10B adopting the two-chamber supply method, shapes of tank objects TO2*a* and TO2*b* are the same as those of the tank objects TOa and TOb of the first embodiment.

In the second embodiment, in the display images RI2*a* and RI2*b*, a shape of a cartridge object CO2*b* is a rectangular shape different from the first embodiment and similar to the objects O2*c* and O2*d*.

According to the second embodiment, the cartridge object CO2*b* corresponding to the printer adopting the two-chamber supply method is the same as one of the shapes (rectangular shapes of diverse lengths) that objects O2*c* and O2*d* can have in accordance with the remaining ratio of the ink Ik. That is, the shape of the cartridge object CO2*b* corresponding to the printer adopting the two-chamber supply method and the shape of the cartridge object (the entire objects O2*c* and O2*d*) corresponding to the printer adopting the one chamber supply method are the same. As a result, the user can easily recognize that each of the cartridge objects corresponds to the ink cartridge.

Meanwhile, also in the second embodiment, like the first embodiment, the shape of the object O2*a* (the tank object TO2*a*) in the display image RI2*a* is different from any shape which the object O2*c* can have in accordance with the remaining ratio of the ink Ik, in the display image RI2*c* corresponding to the printer 100C adopting the one chamber supply method. As a result, like the first embodiment, for example, the user can recognize that the object O2*a* corresponds to the printer 100A adopting the two-chamber supply method.

C. Third Embodiment

FIG. 9B depicts an example of a display area CL33 of the management screen in accordance with a third embodiment. In the third embodiment, a display area CL33 of FIG. 9B is displayed, instead of the display area CL3 (FIG. 7) of the management screen DW of the first embodiment.

The display area CL33 includes display images RI3*a* to RI3*d* corresponding to the printers 100A to 100D. In the example of FIG. 9B, like the example of FIG. 7, the display image RI3*a* indicates the remaining ratio of the ink Ik corresponding to the second accommodation state S2, and the display image RI3*b* indicates the remaining ratio of the ink Ik corresponding to the first accommodation state S1. Also, the display image RI3*c* indicates a relatively small remaining ratio of the ink Ik, and the display image RI3*d* indicates a relatively large remaining ratio of the ink Ik.

In the third embodiment, in the display images RI3*a* and RI3*b* corresponding to the printers 100A and 100B adopting the two-chamber supply method, tank objects TO3*a* and TO3*b* have a shape having a band-shaped part SP and a wide part WP of which a vertical width is larger than the band-shaped part SP, respectively. The shape having the wide part WP and the band-shaped part SP is a shape imitating the intermediate tank 175A and the ink supply path 174A so as to recall the intermediate tank 175A and the ink supply path 174A of FIGS. 2A and 2B.

In the third embodiment, like the second embodiment, a shape of a cartridge object CO3*b* corresponding to the printer adopting the two-chamber supply method is the same as one of the shapes (rectangular shapes of diverse lengths) that objects O3*c* and O3*d* can have in accordance with the remaining ratio of the ink Ik. That is, the shape of the cartridge object CO3*b* corresponding to the printer adopting the two-chamber supply method and the shape of the cartridge object (the entire objects O3*c* and O3*d*) corresponding to the printer adopting the one chamber supply method are the same.

Unlike the second embodiment, the cartridge object CO3*b* and the objects O3*c* and O3*d* have concave portions CVb, CVc and CVd at a left and lower corner portion, respectively. The shape of each of the cartridge objects CO3*b* and the objects O3*c* and O3*d* corresponds to a shape where each of the ink cartridges 200A to 200D has a concave portion CV at a portion at which each of the ink outlets 230A (FIGS. 2A and 2B) and 230C (FIGS. 3A and 3B) is arranged. That is, in the third embodiment, the shape of each of the cartridge object CO3*b* and the objects O3*c* and O3*d* imitates the shape of each of the ink cartridges 200A to 200D. As a result, the user can intuitively recognize that each of the cartridge object CO3*b* and the objects O3*c* and O3*d* corresponds to the ink cartridge and indicates the remaining ratio of the ink Ik corresponding to the state where the ink Ik remains in the ink cartridge.

Also, in the third embodiment, as can be seen from the above descriptions, an object O3*b* corresponding to the printer adopting the two-chamber supply method includes a part (the cartridge object CO3*b*) having a shape corresponding to the ink cartridge, a part (wide part WP) having a shape corresponding to the intermediate tank 175A, and a part (band-shaped part SP) having a shape corresponding to the ink supply path 174A between the ink cartridge and the intermediate tank 175A. As a result, the user can intuitively recognize that the object Ob corresponds to the printer adopting the two-chamber supply method.

Meanwhile, also in the third embodiment, like the first embodiment, the shape of the object O3*a* (tank object TO3*a*) in the display image RI3*a* is different from any shape which the object O3*c* can have in accordance with the remaining ratio of the ink Ik in the display image RI3*c* corresponding to the printer 100C adopting the one chamber supply method. As a result, like the first embodiment, for example, the user can recognize that the object O3*a* corresponds to the printer 100A adopting the two-chamber supply method.

D. Fourth Embodiment

FIG. 9C depicts an example of a display area CL34 of the management screen in accordance with a fourth embodiment. In the fourth embodiment, a display area CL34 of FIG. 9C is displayed, instead of the display area CL3 (FIG. 7) of the management screen DW of the first embodiment.

The display area CL34 includes display images RI4*a* to RI4*d* corresponding to the printers 100A to 100D. In the example of FIG. 9C, like the example of FIG. 7, the display image RI4*a* indicates the remaining ratio of the ink Ik corresponding to the second accommodation state S2, and the display image RI4*b* indicates the remaining ratio of the ink Ik corresponding to the first accommodation state S1. Also, the display image RI4*c* indicates a relatively small remaining ratio of the ink Ik, and the display image RI4*d* indicates a relatively large remaining ratio of the ink Ik.

In the fourth embodiment, in the display images RI4*a* and RI4*b* corresponding to the printers 100A and 100B adopting the two-chamber supply method, tank objects TO4*a* and TO4*b* have a shape having a band-shaped part SP2 and a wide part WP2 of which a vertical width is larger than the band-shaped part SP2, respectively, like the third embodiment.

In the fourth embodiment, a cartridge object CO4*b* corresponding to the printer adopting the two-chamber supply method has a shape having a band-shaped main part MP2 and a left end portion EP2 of which a vertical width is smaller than the main part MP2, like the first embodiment.

In the fourth embodiment, when the object corresponding to the printer adopting the two-chamber supply method, for example, an object O4*b* of FIG. 9C indicates the remaining ratio of the ink Ik corresponding to the first accommodation state S1, a boundary between a cartridge object CO4*b* and a tank object TO4*b* is not explicitly indicated. For this reason, when indicating the remaining ratio of the ink Ik corresponding to the first accommodation state S1, the object O4*b* is seen as one rectangular object. Therefore, in the fourth embodiment, when the object O4*b* indicates the remaining ratio of the ink Ik corresponding to the first accommodation state S1, a shape of the object O4*b* and a shape of an object O4*d* corresponding to the printer adopting the one chamber supply method are the same (FIG. 9C).

For this reason, in the fourth embodiment, when the object O4*b* indicates the remaining ratio of the ink Ik corresponding to the first accommodation state S1, the user cannot recognize from the shape of the object O4*b* that the object O4*b* corresponds to the printer 100B adopting the two-chamber supply method.

Also in the fourth embodiment, like the first embodiment, when an object O4*a* indicates the remaining ratio of the ink Ik corresponding to the second accommodation state S2, a shape of the object O4*a* (tank object TO4*a*) is different from any shape which the object O3*c* can have in accordance with the remaining ratio of the ink Ik in the display image RI3*c* corresponding to the printer 100C adopting one chamber supply method. As a result, like the first embodiment, for example, the user can recognize that the object O4*a* corresponds to the printer 10A adopting the two-chamber supply method.

E. Modified Embodiments (1) In the respective embodiments, the printer that is a processing target, for example, the printer 100A includes the monochrome print execution unit 160 in which the ink of one color (for example, black (K)) is used. Instead, the printer 100A may include a print mechanism in which inks Ik of a plurality of colors, for example, a print mechanism configured to print a color image by using inks of four colors of cyan (C), magenta (M), yellow (Y) and black (K). In this case, the four ink cartridges 200A corresponding to the inks of four colors can be mounted to the printer 100A. The printer 100A includes the ink supply unit 170A for each of the inks of four colors. In this case, for example, the initial amounts of the inks Ik in all or some of the ink cartridges 200A of four colors may be different from each other. For example, the initial amounts of the inks Ik may be different between the CMY ink cartridges 200A of chromatic colors and the K ink cartridge 200A of an achromatic color. Also, the boundary ink amounts in the intermediate tanks 175A corresponding to all or some of the ink cartridges 200A of four colors may be different from each other. For example, the boundary ink amounts may be different between the intermediate tanks 175A corresponding to the CMY ink cartridges 200A of chromatic colors and the intermediate tank 175A corresponding to the K ink cartridge 200A of an achromatic color.

In the present modified embodiment, in the display area of the management screen, the display image of one printer includes four objects corresponding to inks of four colors. For a configuration of each object in the display image, for example, the configuration of the object in the first to fourth embodiments is adopted.

(2) In the respective embodiments, the shape of each object is exemplary and may be modified as appropriate. For example, in the first embodiment, in the display images RIa and RIb corresponding to the printers adopting the two-chamber supply method, the tank objects TOa and TOb can have a circular shape, an elliptical shape or a polygonal shape such as a triangular shape other than the rectangular shape, respectively.

Alternatively, in the display images RIa and RIb corresponding to the printers adopting the two-chamber supply method, the tank objects TOa and TOb can have a rectangular shape, respectively, and in the display images RIc and RId corresponding to the printers adopting the one chamber supply method, the objects Oc and Od can have a shape different from the rectangular shape, for example, a circular shape, an elliptical shape or a triangular shape, respectively.

(3) In the first embodiment, in the display area CL3 of the management screen DW, the display images RIa to RId indicating the remaining ratio of the ink Ik are displayed as images for displaying the index value relating to the remaining amount of the ink Ik. Instead, another index value relating to the remaining amount of the ink Ik may be displayed in the display area. For example, as another index value, the number RN of remaining printable copies may be displayed or the remaining amount of the ink Ik may be displayed. Also in the present modified embodiment, the management screen DW by which the remaining amounts of the ink Ik in the printers 100A to 100D can be easily perceived is provided.

(4) In the embodiments and modified embodiments, each object in the display image is an object linearly extending in the right and left direction as a whole but may also bean object extending in a curved shape. For example, an object extending in an arc shape is also possible. In this case, the index value relating to the remaining amount of the ink Ik is indicated by a length of the object in a longitudinal direction, i.e., in a circumferential direction.

(5) In the above embodiments, the printer that is a processing target, for example, the printer 100A includes the inkjet-type print execution unit 160. Instead, the printer 100A may include an electrophotographic (for example, laser type) print mechanism configured to print an image by using toner as the printing material. In this case, the printer may include a supply unit to which a toner cartridge can be mounted, an intermediate tank (for example, a sub-tank in which toner is temporarily stored) configured to accommodate toner supplied from the toner cartridge mounted to the supply unit, and a print execution unit configured to execute printing by using the toner accommodated in the intermediate tank. The management screen DW of the present embodiment can also be applied to a printer adopting such two-chamber toner supply method.

(6) In the above embodiments, the management device 300 acquires the total number TN of printable copies, the number RN of remaining printable copies and the number SN of printable copies of tank from the printers 100A to 100D, and calculates the cartridge remaining ratio CR and the intermediate tank remaining ratio SR (S135 to S160 in FIG. 5). Instead, each of the printers may calculate the cartridge remaining ratio CR and the intermediate tank remaining ratio SR. In this case, the cartridge remaining ratio CR and the intermediate tank remaining ratio SR are stored in the information database IB of each printer. The management device 300 may acquire, from each printer, the cartridge remaining ratio CR and the intermediate tank remaining ratio SR, in S110 of FIG. 5.

Also, in the management device 300, the number SN of printable copies of tank of each printer may be stored in advance for each model of the printer. In this case, the management device 300 may acquire the number SN of printable copies of tank stored in advance with reference to the model name acquired from each printer. Similarly, in the management device 300, the total number TN of printable copies of the ink cartridge of each printer may be stored in advance for each part number of the ink cartridge. In this case, the management device 300 may acquire the total number TN of printable copies stored in advance with reference to the part number of the ink cartridge acquired from each printer.

(7) In the above embodiments, the output of the display screen data by the management device 300 is performed in a form of displaying the management screen DW (FIG. 7) on the display unit 340 by using the display screen data. Instead, for example, the output of the display screen data by the management device 300 may be performed in a form of transmitting the display screen data to a terminal device (for example, a smartphone or a personal computer) of the user, for example. In this case, for example, the management screen DW (FIG. 7) is displayed on a display unit of the terminal device.

(8) In the above embodiments, the screen data generation processing of FIG. 5 is executed by the management device 300. Instead, each printer that is a management target may generate the display image data and transmit the display image data to the management device 300 by executing the processing of S125 to S165 in FIG. 5. The management device 300 may generate the display screen data representing the management screen DW by using the display image data acquired from each printer.

(9) The management device 300 is connected to the local area network NT. However, the management device 300 may also be connected to the Internet IT. In this case, for example, the printers 100A to 100D transmit the printer information to the management device 300, periodically and spontaneously. The management device 300 executes the screen data generation processing of FIG. 5 by using the printer information. The management device 300 transmits the screen data representing the management screen DW to the terminal device, in response to a request from the terminal device of the user, as described above. In this case, for example, the management device 300 may be a so-called cloud server including a plurality of computation devices capable of performing communication with each other via a network.

(10) In the respective embodiments, some of the configurations implemented by hardware may be replaced with software, and some or all of the configurations implemented by software may be replaced with hardware.

(11) When some or all of the functions of the present disclosure are implemented by a computer program, the computer program may be provided with being stored on a computer-readable storage medium (for example, a non-transitory storage medium). The program may be used with being stored on a storage medium (a computer-readable storage medium), which is the same as or different from the storage medium in which the program has been originally provided. The "computer-readable storage medium" is not limited to a portable storage medium such as a memory card and a CD-ROM, but may include an internal storage device provided in a computer, such as various ROMs, and an external storage device connected to the computer, such as a hard disk drive.

While the present disclosure has been described with reference to the embodiments and modified embodiments, the embodiments are provided so as to easily understand the present disclosure, not to limit the present disclosure. The present disclosure can be changed and improved without departing from the spirit thereof, and includes equivalents thereto.

What is claimed is:

1. A non-transitory computer-readable storage medium storing a computer program readable by a computer, the computer program, when executed by the computer, causing the computer to perform:

acquiring first information about a remaining amount of a first printing material of a first cartridge mounted to a first supply unit configured to supply the first printing material to a first print execution unit, the first supply unit including a tank configured to accommodate the first printing material that is supplied from the first cartridge mounted to the first supply unit, and the first supply unit being configured to supply the first printing material accommodated in the tank to the first print execution unit;

acquiring second information about a remaining amount of a second printing material of a second cartridge mounted to a second supply unit configured to supply the second printing material to a second print execution unit, the second supply unit not including a tank configured to accommodate the second printing material that is supplied from the second cartridge mounted to the second supply unit;

generating display screen data representing a display screen including a first display image which includes a first object for displaying a first value determined using the first information and a second display image which includes a second object for displaying a second value determined using the second information, the first value being an index value relating to the remaining amount of the first printing material and the second value being an index value relating to the remaining amount of the second printing material; and outputting the display screen data, wherein values that the first value can take include: a value corresponding to a first state in which the first printing material remains in the first cartridge and the first printing material remains in the tank; and a value corresponding to a second state in which the first printing material does not remain in the first cartridge and the first printing material remains in the tank, and wherein a shape of the first object indicating the value corresponding to the second state of the values that the first value can take is different from any shape that the second object can have in accordance with the second value.

2. The non-transitory computer-readable storage medium according to claim 1, wherein a shape of the first object indicating an arbitrary value between a minimum value corresponding to the second state and a specific value corresponding to the second state of the values that the first value can take is different from any shape that the second object can have in accordance with the second value.

3. The non-transitory computer-readable storage medium according to claim 1, wherein the first object includes a first sub-object indicating the first value corresponding to the first state and a second sub-object indicating the first value corresponding to the second state, and wherein a shape of the second sub-object is different from any shape that the second object can have in accordance with the second value.

4. The non-transitory computer-readable storage medium according to claim 3, wherein a shape of the first sub-object is same as one of the shapes that the second object can have in accordance with the second value.

5. The non-transitory computer-readable storage medium according to claim 4, wherein the shape of the first sub-object is a shape imitating a shape of the first cartridge.

6. The non-transitory computer-readable storage medium according to claim 3, wherein a shape of the first sub-object is different from any shape that the second object can have in accordance with the second value.

7. The non-transitory computer-readable storage medium according to claim 3, wherein a shape of an end portion of the second sub-object which corresponds to a boundary between the first state and the second state is different from a shape of an end portion of the second object.

8. The non-transitory computer-readable storage medium according to claim 1, wherein a shape of the first object indicating the value corresponding to the first state of the values that the first value can take is different from any shape that the second object can have in accordance with the second value.

9. The non-transitory computer-readable storage medium according to claim 1, wherein the first object includes a part having a shape corresponding to the first cartridge, a part having a shape corresponding to the tank of the first supply unit, and a part having a shape corresponding to a supply path of the first printing material between the first cartridge and the tank.

10. A management device configured to manage a plurality of print execution units, the management device comprising:

a controller configured to:

acquire first information about a remaining amount of a first printing material of a first cartridge mounted to a first supply unit configured to supply the first printing material to a first print execution unit, the first supply unit including a tank configured to accommodate the first printing material that is supplied from the first cartridge mounted to the first supply unit, and the first supply unit being configured to supply the first printing material accommodated in the tank to the first print execution unit;

acquire second information about a remaining amount of a second printing material of a second cartridge mounted to a second supply unit configured to supply the second printing material to a second print execution unit, the second supply unit not including a tank configured to accommodate the second printing material that is supplied from the second cartridge mounted to the second supply unit;

generate display screen data representing a display screen including a first display image which includes a first object for displaying a first value determined using the first information and a second display image which includes a second object for displaying a second value determined using the second information, the first value being an index value relating to the remaining amount of the first printing material and the second value being an index value relating to the remaining amount of the second printing material; and output the display screen data, wherein values that the first value can take include: a value corresponding to a first state in which the first printing material remains in the first cartridge and the first printing material remains in the tank; and a value corresponding to a second state in which the first printing material does not remain in the first cartridge and the first printing material remains in the tank, and wherein a shape of the first object indicating the value corresponding to the second state of the values that the first value can take is different from any shape that the second object can have in accordance with the second value.

11. The management device according to claim 10, wherein a shape of the first object indicating an arbitrary value between a minimum value corresponding to the second state of the values that the first value can take and a specific value corresponding to the second state of the values that the first value can take is different from any shape that the second object can have in accordance with the second value.

12. The management device according to claim 10, wherein the first object includes a first sub-object indicating the first value corresponding to the first state and a second sub-object indicating the first value corresponding to the second state, and wherein a shape of the second sub-object is different from any shape that the second object can have in accordance with the second value.

13. The management device according to claim 12, wherein a shape of the first sub-object is same as one of the shapes that the second object can have in accordance with the second value.

14. The management device according to claim 13, wherein the shape of the first sub-object is a shape imitating a shape of the first cartridge.

15. The management device according to claim 12, wherein a shape of the first sub-object is different from any shape that the second object can have in accordance with the second value.

16. The management device according to claim 12, wherein a shape of an end portion of the second sub-object which corresponds to a boundary between the first state and the second state is different from a shape of an end portion of the second object.

17. The management device according to claim 10, wherein a shape of the first object indicating the value corresponding to the first state of the values that the first value can take is different from any shape that the second object can have in accordance with the second value.

18. The management device according to claim 10, wherein the first object includes a part having a shape corresponding to the first cartridge, a part having a shape corresponding to the tank of the first supply unit, and a part having a shape corresponding to a supply path of the first printing material between the first cartridge and the tank.

19. A management method for managing a plurality of print execution units, the management method comprising:

acquiring first information about a remaining amount of a first printing material of a first cartridge mounted to a first supply unit configured to supply the first printing material to a first print execution unit, the first supply unit includes a tank configured to accommodate the first printing material that is supplied from the first cartridge mounted to the first supply unit, and the first supply unit being configured to supply the first printing material accommodated in the tank to the first print execution unit;

acquiring second information about a remaining amount of a second printing material of a second cartridge mounted to a second supply unit configured to supply the second printing material to a second print execution unit, the second supply unit not including a tank configured to accommodate the second printing material that is supplied from the second cartridge mounted to the second supply unit;

generating display screen data representing a display screen including a first display image which includes a first object for displaying a first value determined using the first information and a second display image which includes a second object for displaying a second value determined using the second information, the first value being an index value relating to the remaining amount of the first printing material and the second value being an index value relating to the remaining amount of the second printing material; and outputting the display screen data, wherein values that the first value can take include: a value corresponding to a first state in which the first printing material remains in the first cartridge and the first printing material remains in the tank; and a value corresponding to a second state in which the first printing material does not remain in the first cartridge and the first printing material remains in the tank, and wherein a shape of the first object indicating the value corresponding to the second state of the values that the first value can take is different from any shape that the second object can have in accordance with the second value.

* * * * *